United States Patent [19]

Cox et al.

[11] 4,336,892

[45] Jun. 29, 1982

[54] ARTICLE DISPENSING APPARATUS

[75] Inventors: Robert N. Cox, Bridgeton; James E. Rawlings, St. Louis, both of Mo.

[73] Assignee: UMC Industries, Inc., Stamford, Conn.

[21] Appl. No.: 150,348

[22] Filed: May 22, 1980

[51] Int. Cl.[3] ..... G07F 11/32

[52] U.S. Cl. ..... 221/125; 221/232

[58] Field of Search ..... 221/125, 126, 127, 129, 221/130, 131, 195, 228, 229, 230, 232

[56] References Cited

U.S. PATENT DOCUMENTS

| | | | |
|---|---|---|---|
| 2,784,872 | 3/1957 | Lux . | |
| 2,952,384 | 9/1960 | Holstein et al. . | |
| 3,001,669 | 9/1961 | Tandler et al. . | |
| 3,128,908 | 4/1964 | Holstein et al. . | |
| 3,193,138 | 7/1965 | Cox et al. . | |
| 3,252,617 | 5/1966 | Ficken . | |
| 3,687,337 | 8/1972 | Burlando et al. | 221/129 |
| 3,722,745 | 3/1973 | Gushi et al. | 221/130 |
| 3,767,084 | 10/1973 | Bayha | 221/279 |
| 4,134,520 | 1/1979 | Collins et al. | 221/129 |
| 4,215,800 | 8/1980 | Collins et al. | 221/129 |
| 4,257,531 | 3/1981 | Kimura et al. | 221/129 X |

FOREIGN PATENT DOCUMENTS

| | | | |
|---|---|---|---|
| 1449258 | 10/1968 | Fed. Rep. of Germany | 221/131 |

*Primary Examiner*—F. J. Bartuska

*Attorney, Agent, or Firm*—Senniger, Powers, Leavitt and Roedel

[57] ABSTRACT

A vendor for packs of cigarettes comprising a cabinet having a window at the front, a plurality of dispensers in the cabinet for the packs, each adapted to hold a plurality of packs of one brand in a row extending in rear-to-front direction in the cabinet, the dispensers being arranged in tiers one above another in the cabinet with a plurality of dispensers located side-by-side in each tier. The tiers are slanted upward from rear to front, and each tier above the lowermost tier overhangs the tier next below at the front. A transparent panel fixed in place at the front of each tier is engageable by the forward packs of the rows in the tier, the fronts of the forward packs being visible through the window and the panel. The forward pack of a row is dispensed, upon its selection by a purchaser (and accompanying deposit of an amount sufficient for its purchase), by being pushed down from behind the respective transparent panel, and drops down to a delivery pan located below the window. Space is provided between the front of each tier and the window to allow the packs dispensed from any tier above the lowermost tier to drop down into the pan.

24 Claims, 19 Drawing Figures

ARTICLE DISPENSING APPARATUS

BACKGROUND OF THE INVENTION

This invention relates to article dispensing apparatus, more particularly to a vendor for packs of cigarettes, and a dispenser used in the apparatus for dispensing the articles.

The invention is in the same general field as the vendors shown in U.S. Pat. Nos. 2,952,384; 3,128,908; 3,252,617 and 3,193,138.

SUMMARY OF THE INVENTION

Among the several objects of the invention may be noted the provision of a new vendor for packs of cigarettes which displays the packs to be vended in a most effective manner for merchandizing, the principles of the invention being applicable to apparatus for dispensing articles other than packs of cigarettes particularly articles similar in shape to a pack of cigarettes; the provision of such a vendor which, for its size, is adapted to hold a wide variety of brands of cigarettes, and a substantial number of packs of each brand; the provision of a vendor such as described adapted to display and dispense the packs in an interesting and pleasing manner; the provision of such a vendor the front of which has the general appearance of being open (and which may hence be referred to as an "open-front" vendor), the packs being held in rows extending from rear-to-front in the cabinet with the front of the forward pack of each row being highly visible through a window at the front of the vendor, and being dispensed to a customer on his selection thereof, so that the pack the customer sees and selects is the pack he receives; the provision of such a vendor as to which, while its interior appears to be open, the mode of dispensing is not readily apparent; the provision of such a vendor which may be utilized for first-in first-out dispensing of the packs; and the provision of an improved dispenser for such a vendor adapted not only to handle packs of different thickness, with all packs in the dispenser of the same thickness, but also to handle packs of different thickness in the dispenser at one time.

In general, article dispensing apparatus of this invention comprises a cabinet having a window at the front and a delivery station below the window. In the cabinet are article dispensers, each adapted to hold a row of articles extending in rear-to-front direction in the cabinet. The dispensers are arranged in tiers, one above another, in the cabinet with a plurality of dispensers in each tier located in side-by-side relation in the tier. Each dispenser has stop means, e.g. a transparent panel fixed in place at its front end engageable by the forward article of the respective row of articles. The fronts of the forward articles in the rows are visible through the window and the stop means. Means is provided for dispensing the forward article of each row down from behind said stop means, and means is provided for moving the row forward upon the dispensing of the forward article to bring the next article forward into engagement with said stop means.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
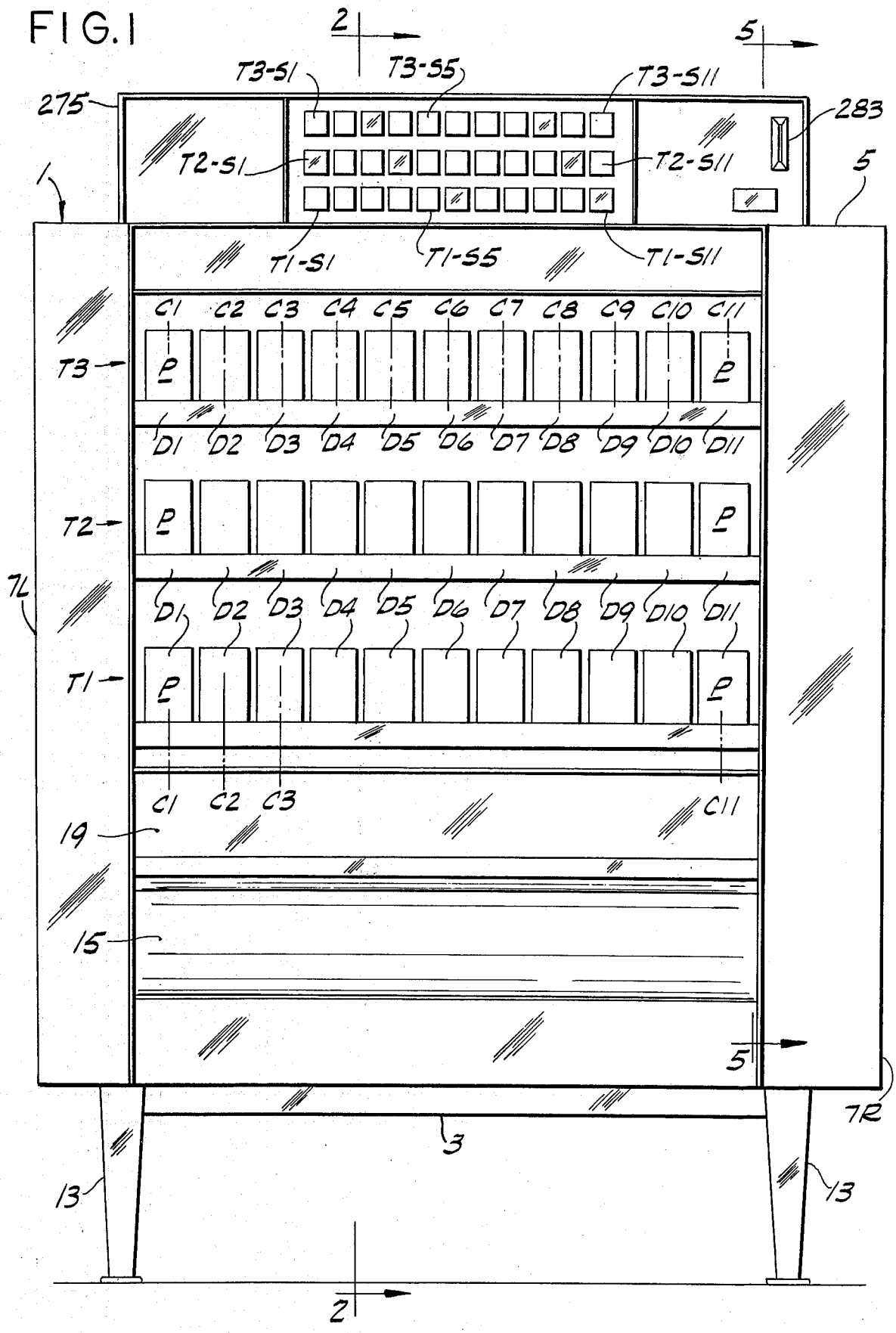
FIG. 1 is a front elevation of a cigarette vendor of this invention, showing how packs of cigarettes appear through a window at the front of the vendor.

Referring to the drawings, an article dispensing apparatus, and more particularly a cigarette vending machine (vendor) of this invention, is shown to comprise a cabinet generally designated 1 (see FIGS. 1 and 2) having a bottom 3, top 5, left and right sides 7L and 7R, and a front door 9 having a window 11 therein. A plurality of article dispensers (for packs of cigarettes in the present instance) are provided in the cabinet. Each dispenser is denoted generally by the reference character D. Each is adapted to hold a row R of the articles, i.e., packs P of cigarettes, extending in rear-to-front direction in the cabinet. The dispensers are arranged in tiers, one above another, in the cabinet with a plurality of dispensers in each tier located in side-by-side relation in the tier. As shown in FIG. 2 there are three such tiers, designated T1, T2, and T3, T1 being the lower tier, T2 the intermediate tier and T3 the top tier. In an actual embodiment of the vendor, herein disclosed, there are eleven dispensers in each tier located side-by-side in the tier. The dispensers in the respective tiers may be identified as T1-D1 to T1-D11 for the bottom tier, T2-D1 to T2-D11 for the intermediate tier, and T3-D1 to T3-D11 for the top tier. The D1 dispensers in the three tiers are located generally in a rear-to-front vertical plane or column indicated at C1 in FIG. 1 at the left in the cabinet, the D2 dispensers are located in a rear-to-front vertical plane or column C2 next to C1, and the other dispensers are similarly located in planes C3-C11 with C11 at the right in the cabinet.

The cabinet may stand on legs 13. At a delivery station at the bottom of the front door 9 of the cabinet is a delivery receptacle or pan 15 extending generally the full width of the tiers for receiving a pack P dispensed from any of the dispensers in any of the tiers. The pack in the pan is accessible to the purchaser via a delivery opening 17 at the top front of the pan, extending generally the full width of the pan. A delivery door 19 is provided for this opening, pivoted for swinging movement on an axis at its upper edge, as by means of pivot pins (not shown) at the top of the ends of the door 19. The window 11, generally speaking, extends from just above the top of the delivery door 19 to adjacent the top of the front door 9 of the cabinet, and extends widthwise from adjacent one side to the other of the front door 9 of the cabinet, being slanted back from bottom to top.

Each dispenser has transparent stop means as indicated at 21 fixed in place at its front end engageable by the front face of the forward pack P of cigarettes of the respective row R of packs. More particularly, the transparent stop means 21 for all eleven of the dispensers D1-D11 of each of the three tiers T1, T2, T3 is constituted by a single transparent panel (e.g., a transparent plastic or glass panel) extending across the front of the tier. Each dispenser includes means indicated generally at 23 for dispensing the forward pack P of the respective row R down from behind the respective transparent panel 21, and means indicated generally at 25 for moving the row forward upon the dispensing of the forward (front) pack to bring the next pack forward into engagement with the transparent panel 21 ready for dispensing.

Figure 4:
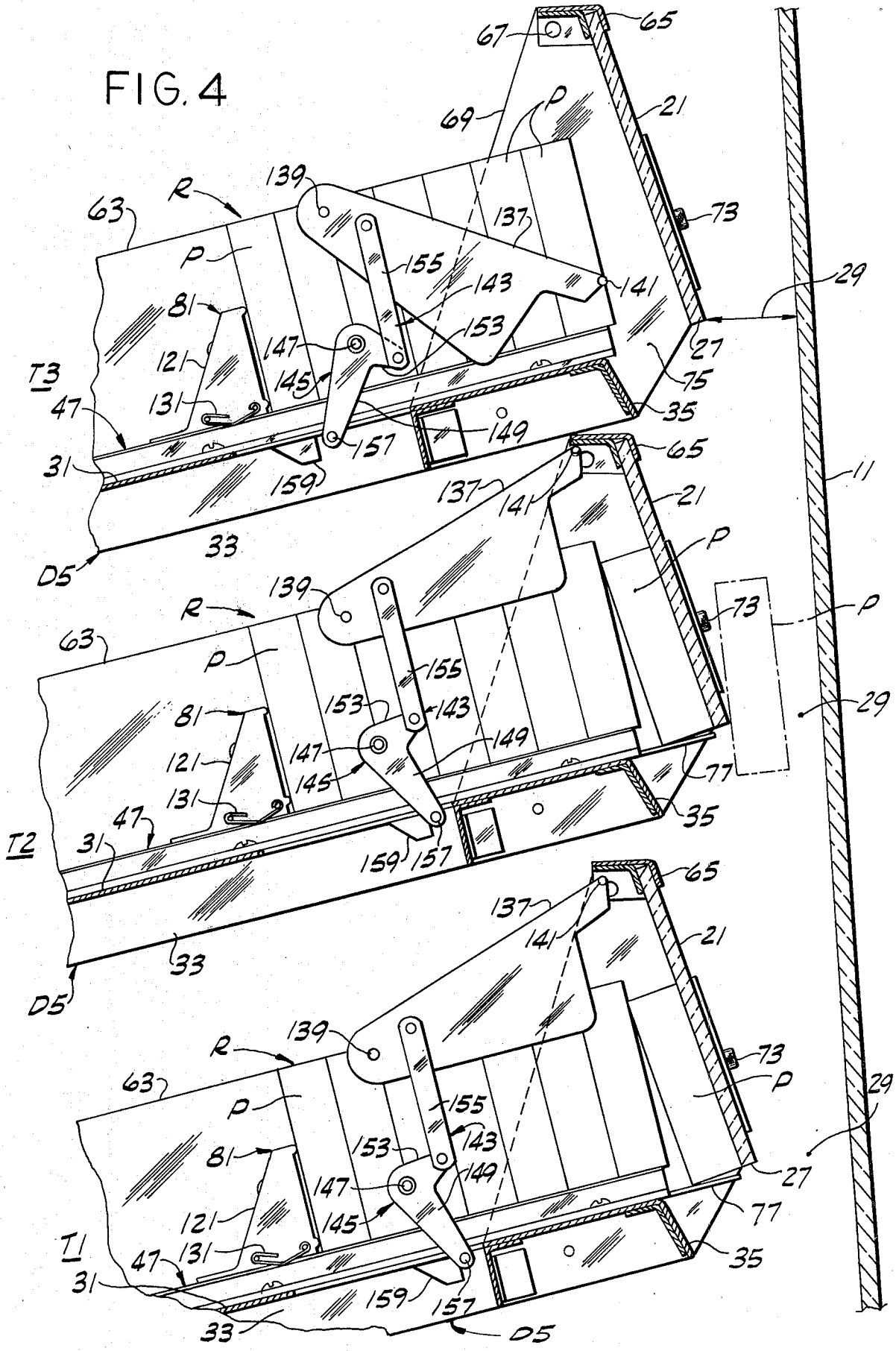
FIG. 4 is an enlarged fragment of FIG. 2 showing how a pack of cigarettes is ejected and how it drops into the delivery receptacle of the vendor for delivery to the customer.

Each tier T1-T3, and hence each dispenser D1-D11 in each tier, is slanted up in the cabinet from the rear toward the front of the cabinet as appears in FIGS. 2 and 4. The window 11 is in a plane slanted back at an acute angle from the vertical plane through the bottom of the window, and the planes of the tiers and dispensers are slanted up from the rear toward the front at an acute angle from the horizontal, the latter angle being greater than the former. Thus, the first stated angle may be about 5°, and the second may be about 15°, for example. The transparent panel 21 of each tier is slanted back from the bottom to the top thereof at the front of the tier. Rather than being in a transverse plane perpendicular to the inclined plane of the tier, the panel 21 is in a transverse plane slanted back at a relatively small acute angle, e.g., about 5°, from a transverse plane perpendicular to the tier (see FIG. 4).

As to each dispenser, the bottom edge 27 of the respective panel 21 at the front end of the dispenser (at the closest point of the dispenser to the window 11) is spaced rearwardly from the window 11 so that there are spaces 29 between edges 27 and the window to allow packs of cigarettes to drop down between the edges 27 and the window. Each space 29 is kept to a minimum, being somewhat greater than the thickness of a pack to allow a pack to drop, but less than double the thickness of the thinnest pack anticipated. For example, with packs of cigarettes about $\frac{7}{8}''$ thick, the distance between edge 27 and the window 11 (measured at right angles to the window) may be about $1\frac{1}{4}''$ as shown in FIG. 4 to allow sufficient space for packs to drop readily between edge 27 and the window, without allowing so much space as to make it necessary to increase the depth (i.e., the rear-to-front dimension) of the cabinet to provide high capacity for packs of cigarettes in the cabinet.

Each dispenser in each of the tiers T2 and T3 above the lowermost tier T1 overhangs the front face of the transparent panel 21 next below, whereby a pack disposed from a dispenser in tier T3 may drop down on the front face of the panel 21 of tier T2 next below, and through the space 29 between the bottom of the forward end of the dispensers in tier T2 and the window 11 (i.e., the space between the bottom edge 27 of the tier T2 panel 21 and the window 11), and a pack disposed from a dispenser in tier T2 may drop down on the front face of the panel 21 of tier T1 next below and through the space 29 between the bottom of the forward end of the dispensers in tier T1 and the window 11 (i.e., the space between the bottom edge 27 of the tier T1 panel 21 and the window 11). The fronts of the forward packs P in the rows R are readily visible through the window 11 and the transparent panels 21.

Figure 5:
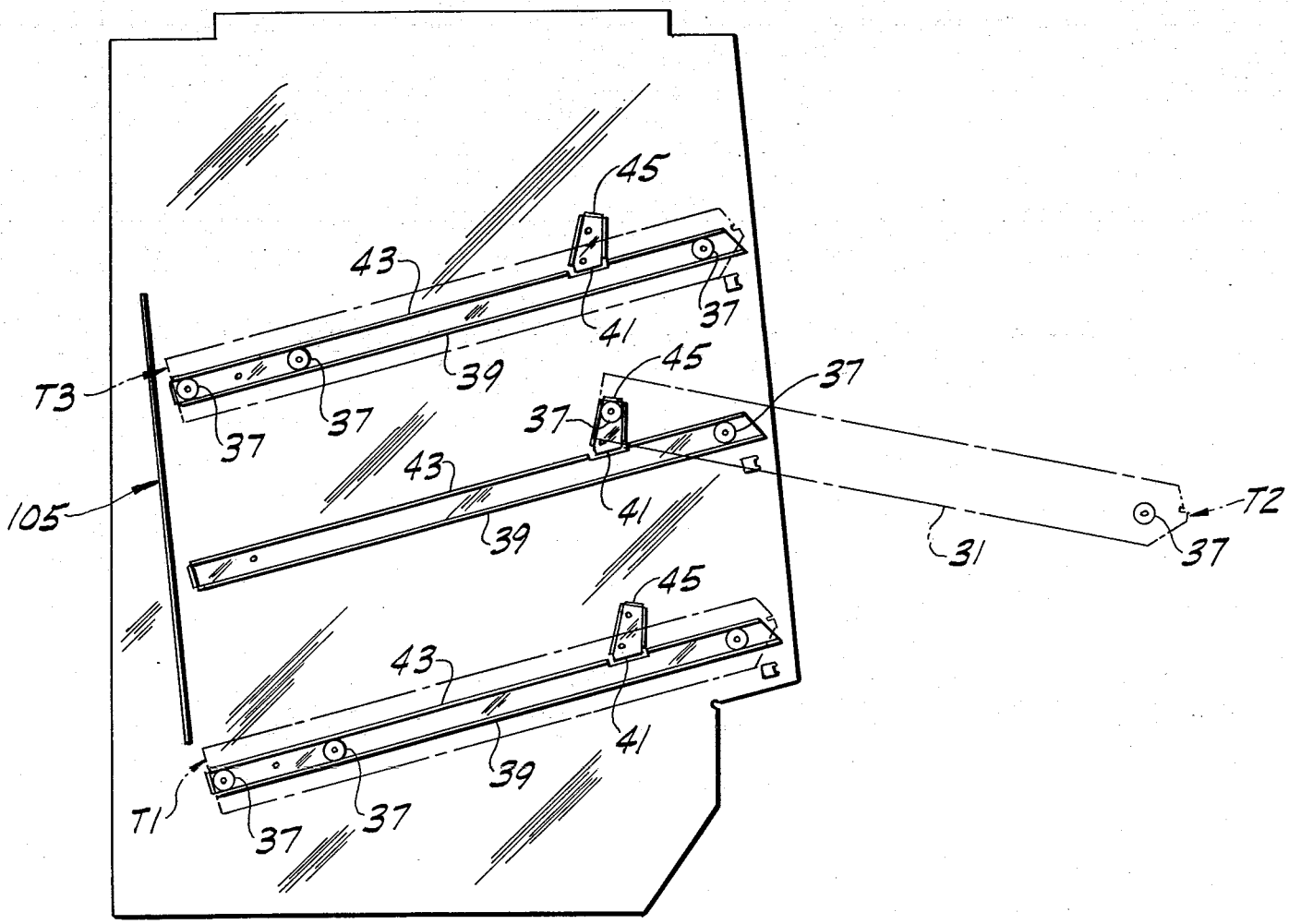
FIG. 5 is a vertical section of the vendor on the front-to-rear plane of the vendor indicated at 5—5 in FIG. 1, and showing in phantom a loading position of the intermediate tray or shelf of the vendor.

Each of the tiers T1, T12, T3 of dispensers comprises a rectangular sheet metal tray or shelf 31 having sides 33 and a downturned front lip 35. Each of these shelves has rollers 37 at its sides received in supporting channels 39 (see FIG. 5) on the insides of the sides of the cabinet slanting up from the rear toward the front at the aforesaid angle. With the shelves slanted as shown, they may all be identical (for economy in manufacture of the vendor). The trays or shelves 31 are adapted to be slid out of the cabinet on opening the front door 9, and may be tilted down to approximately 10° below horizontal as permitted by gaps at 41 in the upper flanges 43 of the channels for upward movement of the rear rollers 37 out of the channels and into retainers 45 for these rollers when moved up out of the channels.

Each shelf 31 constitutes a base for the eleven dispensers D1-D11 of the respective tier T1-T3, the dispensers being located side-by-side on the shelf. Each dispenser comprises means indicated generally at 47 extending in rear-to-front direction on the shelf for bottomwise supporting a row R of packs P to be dispensed, "bottomwise" meaning that the packs are supported at their bottoms in stand-up position on said supporting means. The latter comprises a pair of rails each designated 49 extending in spaced-apart parallel relation in rear-to-front direction on the shelf, each rail having a bottom flange 51, a web 53 extending up from the bottom flange, and a head 55 on the web. A rib 57 extends inward from the web providing an upper guide channel 59 between the head and the rib and a lower guide channel 61 between the rib and the upper surface of the shelf 31. The two rails are mounted on the shelf with the guide channels opening in the direction toward one another and with the heads of the rails spaced a distance less than the width of a pack P. Partitions 63 are provided extending up from the shelf between the pairs of rails, i.e., between the dispensers D1-D11, and at the outside of dispensers D1 and D11 for sidewise confinement of the rows of packs while permitting them to slide forward on the heads of the rails.

Figure 6:
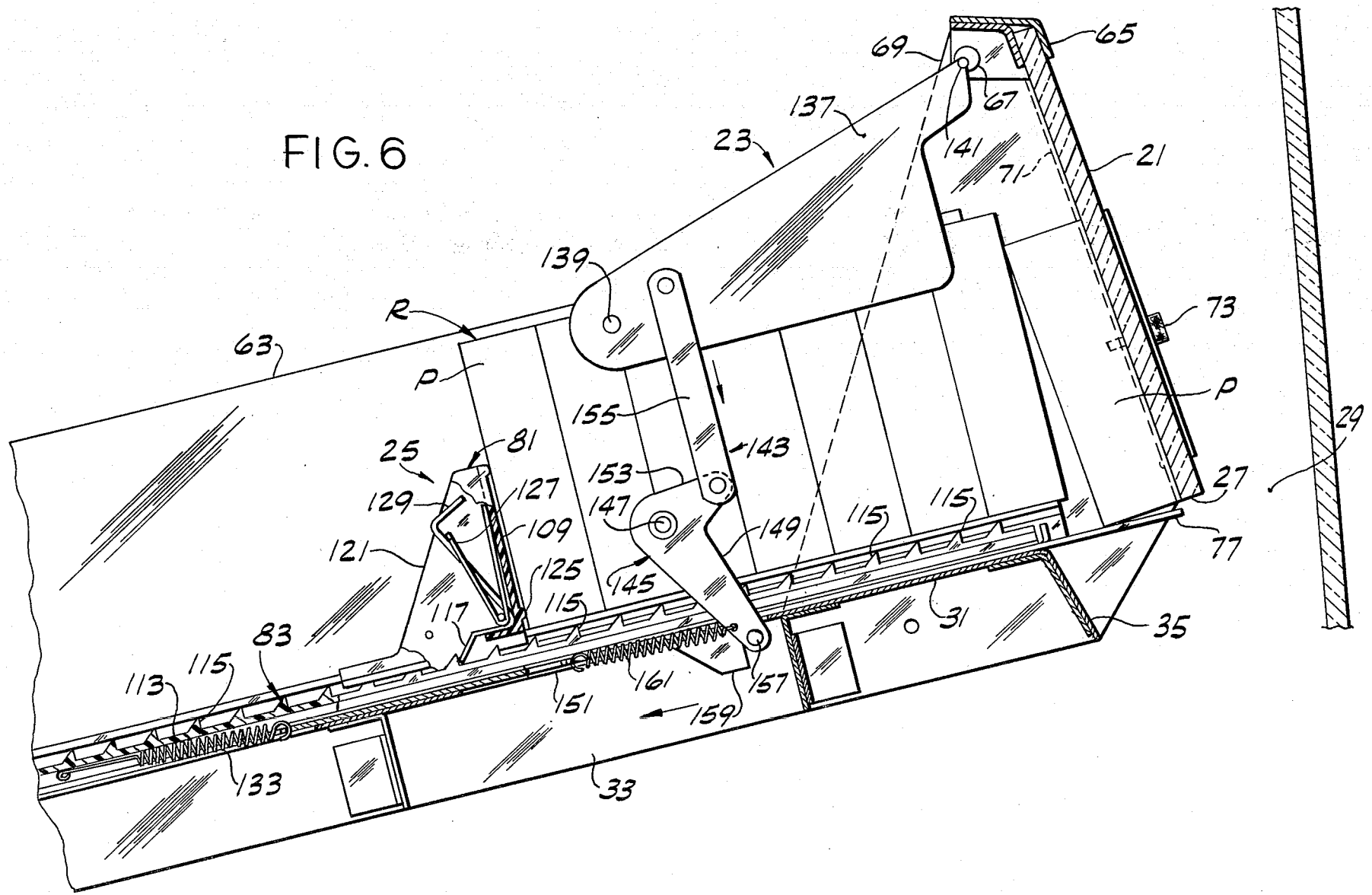
FIGS. 6 and 7 are enlarged vertical sections on line 6—6 and 7—7, respectively, of FIG. 3, these two figures together comprising a complete vertical longitudinal section of any one of a plurality of dispensers of the vendor.

The transparent panel 21 for each tier is carried by a hinge member 65 which extends along the top of the panel and which is pivoted at its ends by means of pins 67 on brackets 69 at the forward ends of the sides of the shelf for swinging movement at the panel between its normal downwardly extending fixed position of FIG. 6 and a forwardly extending raised position for facilitating cleaning it. The fixed (operative) position of the panel is determined by its engagement with front flanges 71 on the brackets, and suitable means such as indicated at 73 is provided for locking it in its fixed position. The arrangement is such that, with the panel 21 in its fixed position, a pack discharge opening 75 (see FIG. 4, particularly) is provided between the forward end of the shelf 31 and the lower edge 27 of the panel, the panel being angled as aforesaid relative to the shelf.

Each dispenser includes a trap door 77 for its pack discharge opening 75 slidable in the lower guide channels 61 of the rails 49 and of the dispenser movable between a forward position wherein it closes the opening 75 and a rearward open (retracted) position clear of the opening 75 for the downward discharge of the forward pack through the opening 75. Means indicated generally at 79 is provided for moving the trap door from its forward closed position back to its rearward open position for the discharge of the forward article. The aforesaid means 25 for moving row R of packs forward in each dispenser comprises a pusher 81 engageable with the rearward pack of the row for pushing the row forward, and means indicated generally at 83 operable by the trap door for driving the pusher 81 forward on a forward stroke of the trap door without driving the pusher means rearward on a rearward stroke of the trap door. The aforesaid means 23 for dispensing the forward pack in each dispenser is operable by the trap door of the dispenser on its rearward stroke for pushing the forward pack of the row of packs in the dispenser down and out through the discharge opening 75 (as opened up by the retraction of the trap door). The trap door of each dispenser is normally at rest in its forward closed position, and the forward pack of the row in the dispenser is positioned somewhat below the remainder of the packs in the row down on the trap door, with the front face of the forward pack engaged against the panel 21. When the trap door opens, means 23 pushes the forward pack down from behind the panel through the opening 75. The trap door returns to closed position and pusher 81 is driven forward to drive the row of packs forward to the point where the forward pack drops down off the rails 49 onto the trap door and is pushed against the panel 21.

Figure 7:
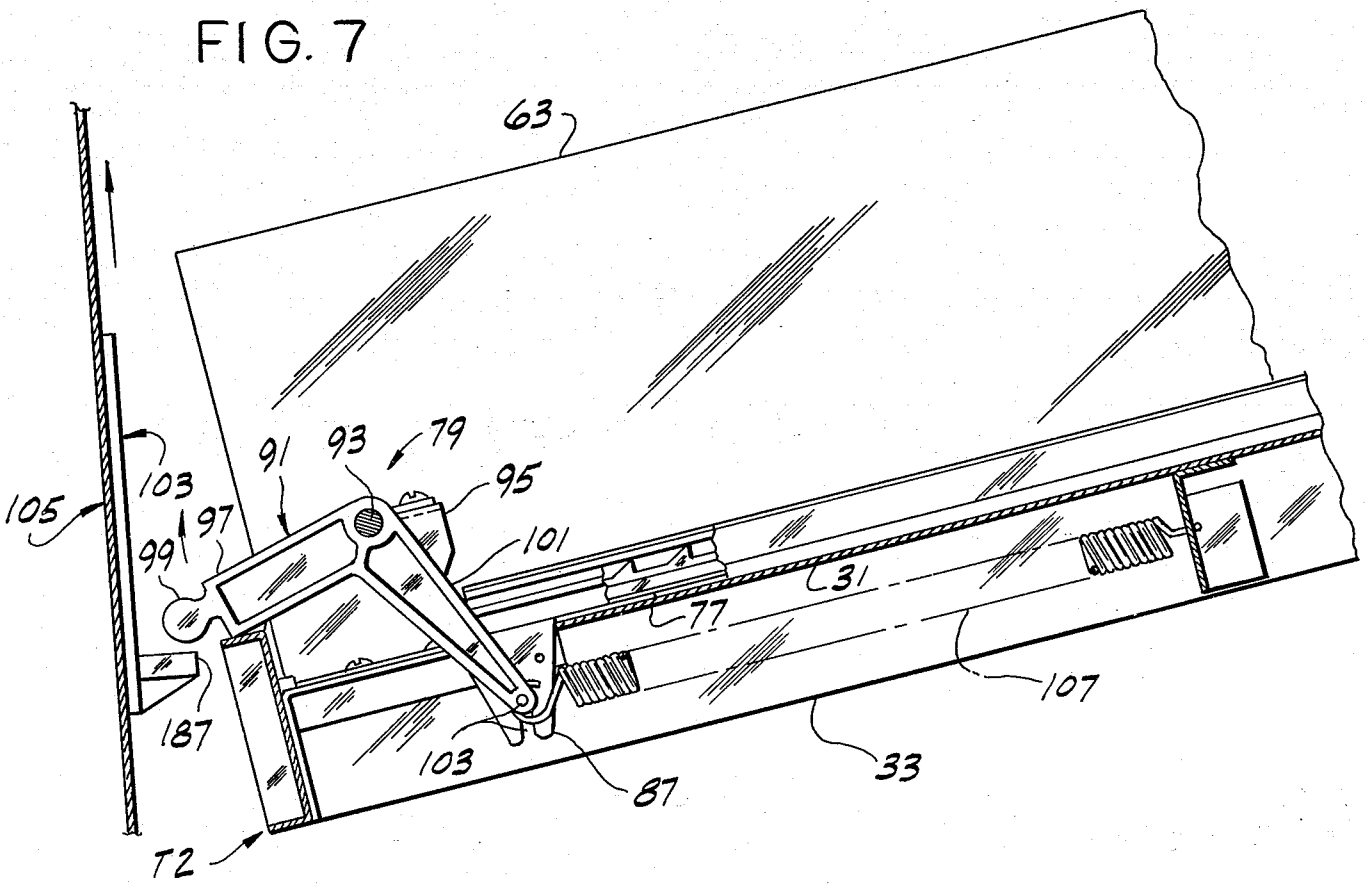
Figure 8:
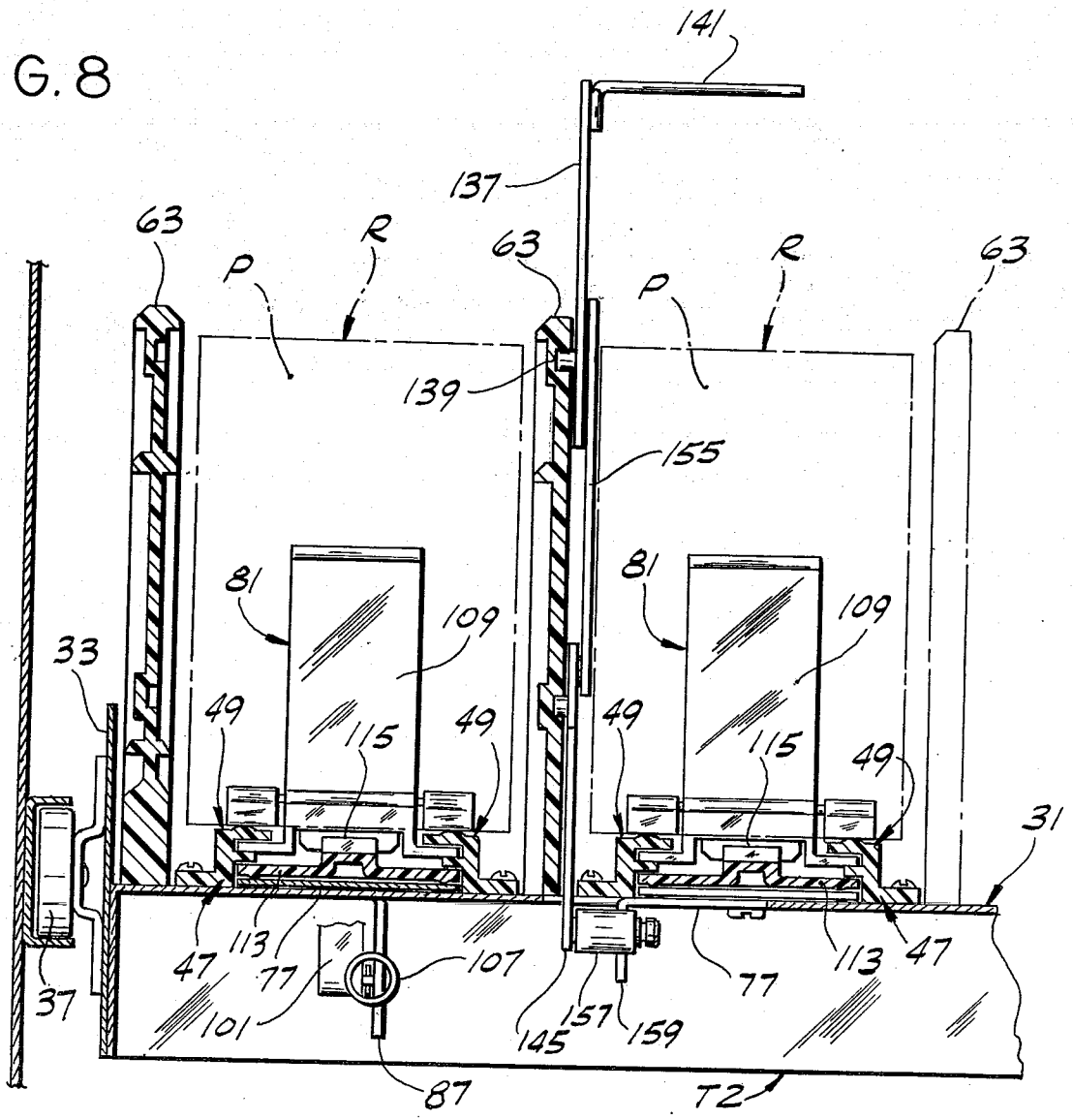
FIG. 8 is an enlarged section on line 8—8 of FIG. 3.
Figure 9:
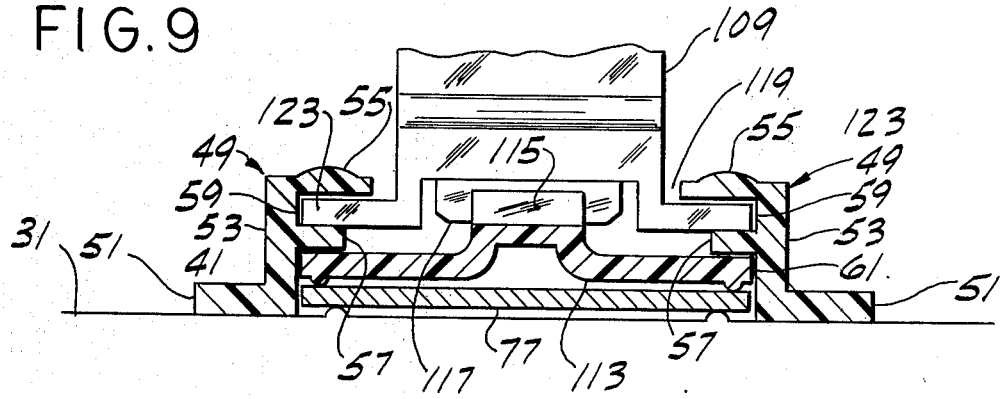
FIG. 9 is an enlarged fragment of FIG. 8.
Figure 10:
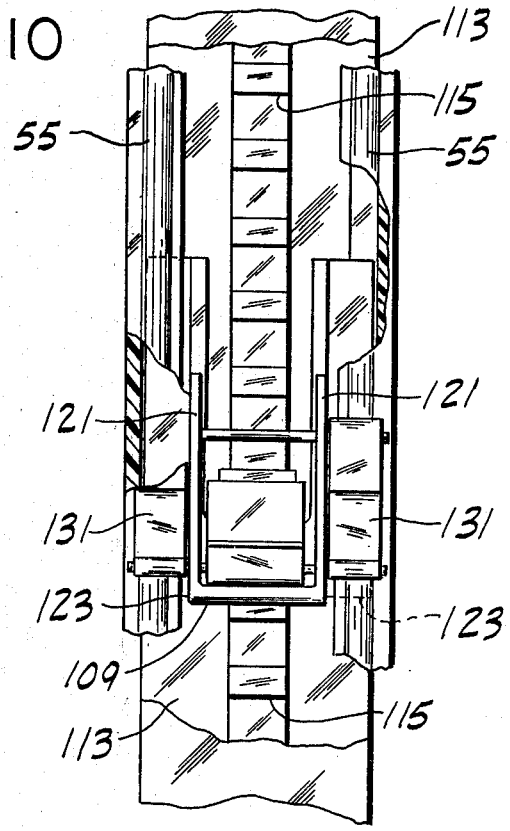
FIG. 10 is an enlarged fragment of FIG. 3 with parts broken away and shown in section.

The trap door 77 generally is constituted by an elongate flat metal strip which extends from adjacent the rear of the shelf 31 to the front of the shelf, being slidable in rear to front direction on the shelf guided in the lower guide channels 61 of the rails 49, and having a lug 87 at its rear end extending down through a slot 89 in the shelf (see FIG. 7). The means 79 for sliding the trap door back and forth between its closed and open positions comprises a bell crank lever 91 pivoted at 93 on a bracket 95 on the shelf, having an operating arm 97 extending rearward with a rearward ball end 99 and an arm 101 extending downward through the slot 89 having a pin and slot connection as indicated at 103 with the lug 87. The ball end 99 of arm 97 of the bell crank 91 of each dispenser is engageable by an actuator 103 carried on a carriage plate 105 which is movable for moving the actuator 103 to swing the bell crank clockwise as viewed in FIG. 7 to move the trap door rearward, all as will be later described in detail. The trap door is biased by a spring 107 to slide forward toward its closed position.

The pusher 81 for the row R of packs P in each dispenser comprises a plate 109 slidable in the upper guide channel 59 of the rails 49 engageable with the rear face of the rearward pack of the row. The means 83 is operable to drive the pusher plate 109 forward, comprising a rack 113 having ratchet teeth 115 slidable on top of the trap door 77 in the guide channels 61 of the rails 49, and a pawl 117 on the pusher 109 engageable with the ratchet teeth. The pusher plate 109 is engageable with the rear face of the rearward pack, this plate being narrower than the space 119 between the heads 55 of the rails 49 and being slidable in this space, the plate 109 having side walls 121 with outwardly extending flanges 123 at the lower edges of the side walls slidable in the guide channels 59. The side walls 121 extend rearwardly from the plate 109 and the teeth 115 extend up between the side walls. The pawl 117 is pivoted at 125 at the back of the plate 109 and is biased by a spring 127 into engagement with the ratchet teeth. A lever for manually releasing the pawl is indicated at 129. The pusher carries non-return spring detents 131 frictionally engageable with and slidable on the rails 49. A coil tension spring 133 interconnects the trap door 77 and the rack 113 the arrangement being such that as the trap door 77 moves forward through a forward stroke it acts via the spring 133 to pull the rack forward, and the rack, in moving forward, is adapted to act via engagement of one of its ratchet teeth 115 with the pawl 117 to drive the pusher plate 109 forward to push the row R of packs forward (after discharge of the preceding forward pack).

The means 23 of each dispenser operable by the trap door 77 of the dispenser on its rearward stroke for pushing the forward pack down and out through the discharge opening 75 (as opened up by the retraction of the trap door) comprises an ejector lever or arm 137 pivoted at 139 on the partition 63 at one side of the dispenser extending forward from the pivot closely adjacent the said partition (between the partition and the row of packs) and having an ejector finger 141 at its forward end extending laterally over the top of the forward pack P in position to push down the forward pack on downswing of the arm 137. The latter is adapted to be swung down on retraction of the trap door 77 by means of a linkage 143 comprising a bell crank 145 pivoted at 147 on the said partition 63, having an arm 149 extending downwardly through an opening 151 in the shelf and an arm 153 extending forwardly from the pivot, a link 155 interconnecting arms 153 and 137. A pin 157 extending laterally from the lower end of bell crank arm 149 is engageable by a lug 159 on the bottom of the trap door 77, this lug extending down through the opening 151, and a coil tension spring 161 is interconnected between the bell crank arm 149 and the trap door 77, the arrangement being such that on rearward retraction of the trap door and attendant rearward movement of the lug 159, the trap door acts through the spring 161 to swing the bell crank 145 clockwise as viewed in FIG. 6 and thereby to pull down the ejector arm 137 to eject the forward pack. Then, on the return (forward) stroke of the trap door 77, lug 159 swings the bell crank 145 counterclockwise to return the ejector arm 137 to its raised retracted position. In this position, the ejector finger 141 is located adjacent but spaced rearward of the panel 21, above the top of the longest pack of cigarettes.

Figure 11:
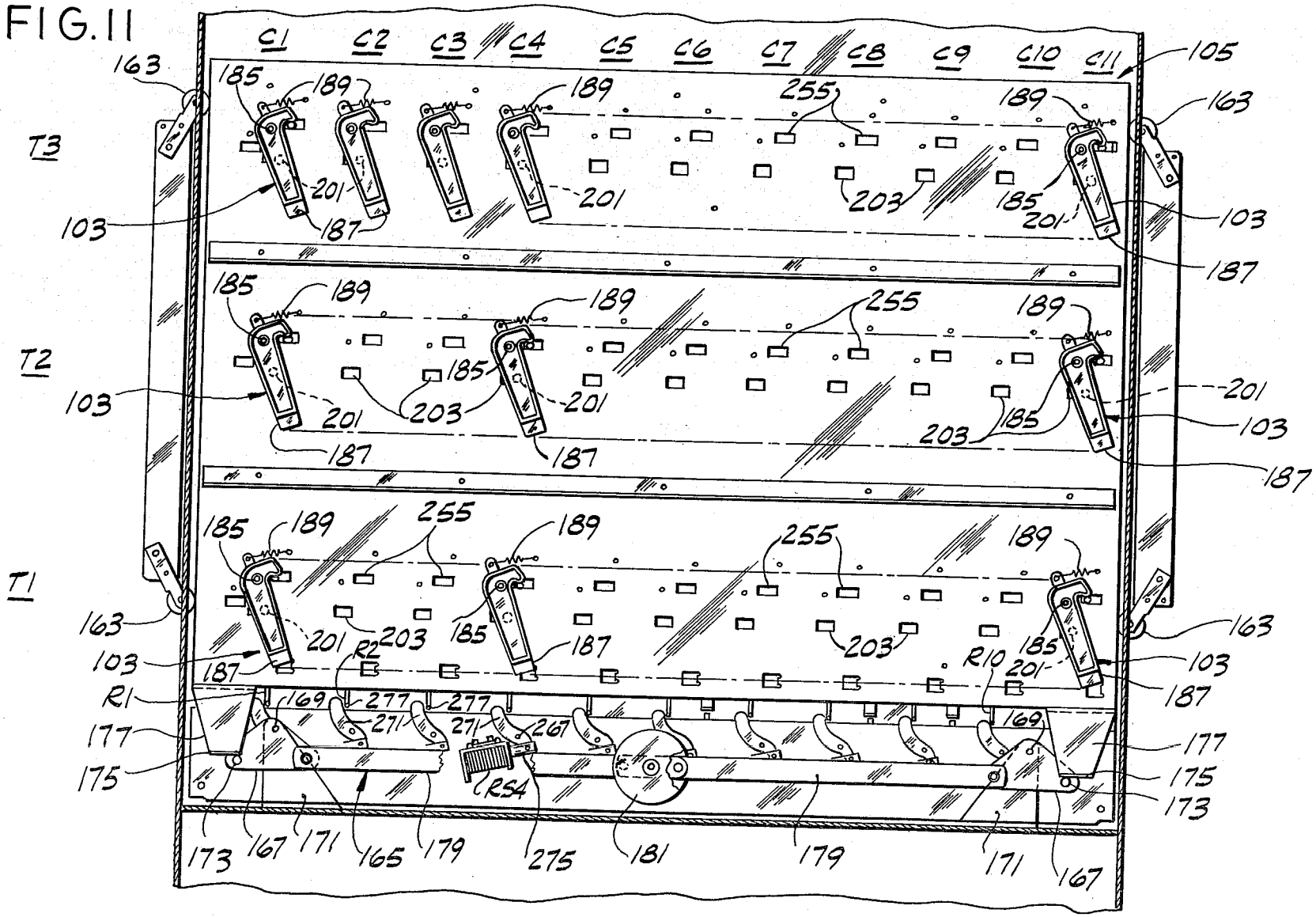
FIG. 11 is an enlarged section on line 11—11 of FIG. 2, showing a carriage or drive plate of the vendor, as viewed from the front of this plate.
Figure 12:
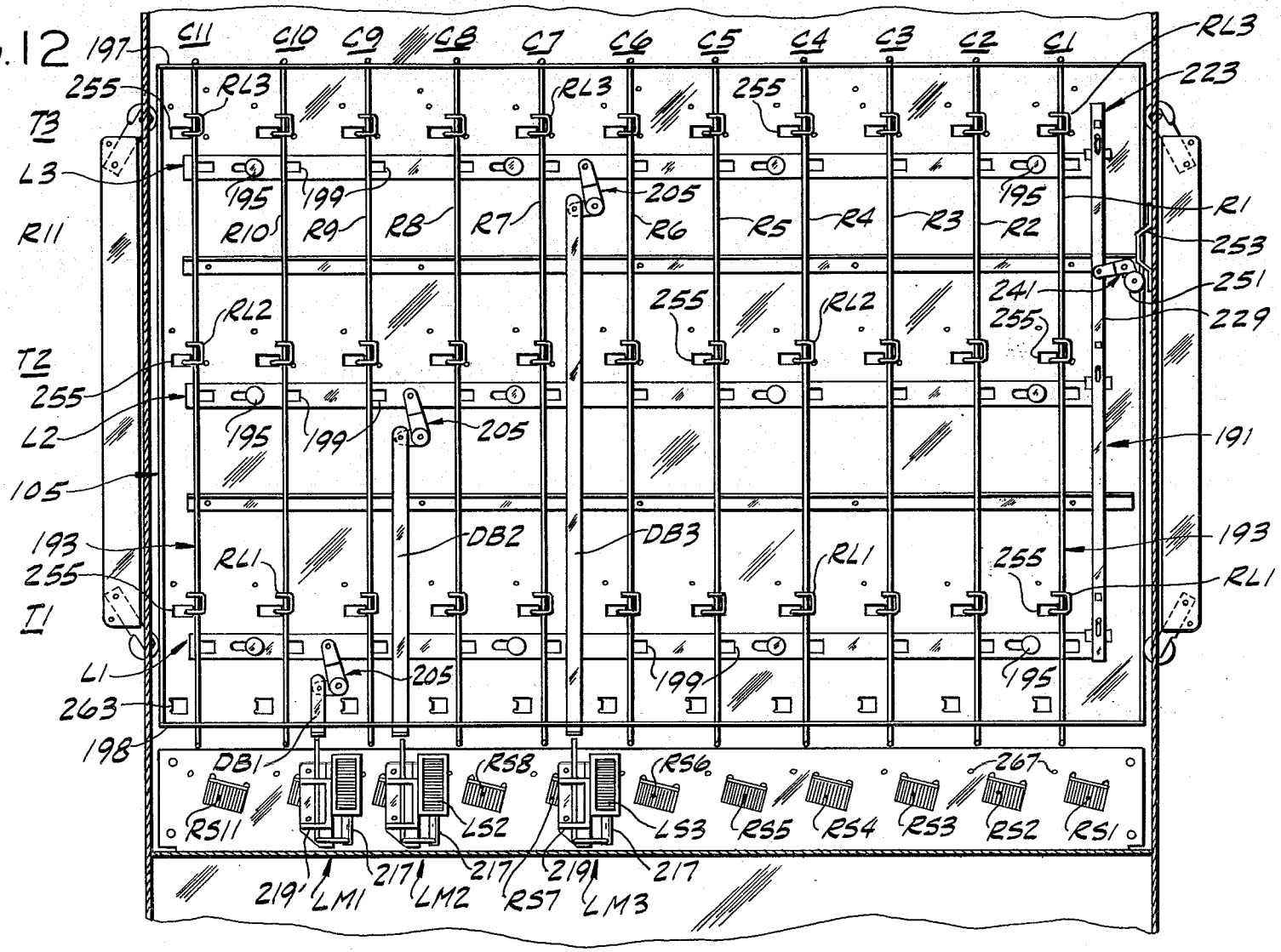
FIG. 12 is a view of the back of the drive plate shown in FIG. 11, taken on line 12—12 of FIG. 2.

The means 79 for sliding the trap doors 77 back and forth between their forward closed position and their rearward open position is operable selectively to actuate the bell crank 91 in accordance with the pack selection made by a customer. Carriage plate 105 of means 79, which may also be referred to as the drive plate, carries a plurality of the bell crank actuators 103, one for each of the bell cranks 91. The carriage or drive plate 105 is mounted for up and down movement in its plane at the rear of the trays or shelves 31 in the cabinet, means for mounting the plate for such movement being shown to comprise pairs of grooved guide rollers 163 (see FIG. 11) at the left and the right in the cabinet receiving the side edges of the plate. These rollers are disposed to guide the plate 105 for up and down movement in a plane slanted somewhat rearward off vertical in upward direction (see FIG. 2). Means indicated generally at 165 is provided for effecting up and down movement of the plate 105 through a stroke corresponding to the throw of the bell cranks 91 needed to move the trap doors 77 through their stroke. This means 165 is shown in FIG. 11 generally to comprise a pair of lift levers each designated 167 each pivoted at 169 on the bracket 171 on the bottom of the cabinet adjacent the rear of the cabinet, each lever 167 having a lift roller 173 engaging a foot 175 on a leg 177 extending down from the lower edge of the plate 105, and a pair of links 179 interconnecting a crank constituted by a pair of disks 181 driven by a gearmotor 183 (i.e., an electric motor/speed reducer unit) and the lift levers 167. Whenever a customer makes a selection after having deposited an amount sufficient for the purchase of a selected pack (as viewed by the customer through the window 11) the motor 183 is energized to drive the crank through a single revolution to effect raising of the plate 105 from the lowered retracted position in which it appears in FIG. 11 to a raised position, and then to effect lowering of the plate back down to its lowered position. The plate 105 is gravity-biased down to its lowered position (it may be cam driven down). With three tiers and eleven dispensers in each tier, totaling thirty-three dispensers, there are thirty-three bell crank actuators 103. These are arranged on the carriage or drive plate 105 in a three by eleven matrix, i.e., in three horizontal rows (corresponding to the three tiers) of eleven each and in eleven vertical rows (corresponding to the eleven columns (C1–C11) of three each. Each bell crank actuator 103 comprises a lever pivoted at 185 on the front of the plate 105 extending down from the pivot and having a forwardly extending foot 187 (see FIG. 7) at its lower end for engagement with the ball end 99 of arm 97 of the respective bell crank 91. Lever 103 is swingable on the pivot 185 between a retracted position wherein the foot is clear of the ball end 99 as the plate 105 rises and an operative position wherein the foot 187 is engageable with the ball end 99 to swing the crank 91 clockwise as viewed in FIG. 7 to retract the respective trap door 77 as the plate 105 rises. Each lever 103 is biased by a spring 189 to swing to its operative position, and is normally held back in its retracted position by first and second latching means generally designated 191 and 193, respectively (see FIG. 12), the arrangement being such, as will appear, as to require release of both of the latching means for a given lever to release it to be swung from its retracted position to its operative position by its spring 189.

The first and second latching means 191 and 193 are operable on a matrix principle, the first comprising three latch bars L1, L2 and L3 for the three tiers T1, T2 and T3, respectively, and eleven latch rods R1–R11 for the eleven columns C1–C11, respectively. The levers 103 are arranged on the front of plate 105 in three horizontal rows corresponding to the three tiers T1–T3 and in eleven vertical rows corresponding to the eleven columns C1–C11. Latch bar L1 controls the levers 103 in the lower horizontal row T1; latch bar L2 controls the levers 103 in the intermediate row T2; latch bar L3 controls the levers 103 in the upper row T3. Each of bars L1–L3 is mounted as indicated at 195 for horizontal sliding movement on the back of the plate 105, bar L1 being at the level of the lower horizontal row T1 of levers 103, bar L2 being at the level of the intermediate horizontal row T2 of levers 103, and bar L3 being at the level of the upper horizontal row T3 of levers 103. Latch rods R1–R11 control the levers 103 in the vertical rows CR–CR11, respectively, of these levers. Each of the latch rods R1–R11 is mounted on the back of plates 105 in flanges 197 and 198 at the top and bottom of plate 105, the rods extending heightwise with respect to the plate 105 at the locations of the vertical rows of levers 103 with each rod rotatable on its axis.

Figure 13:
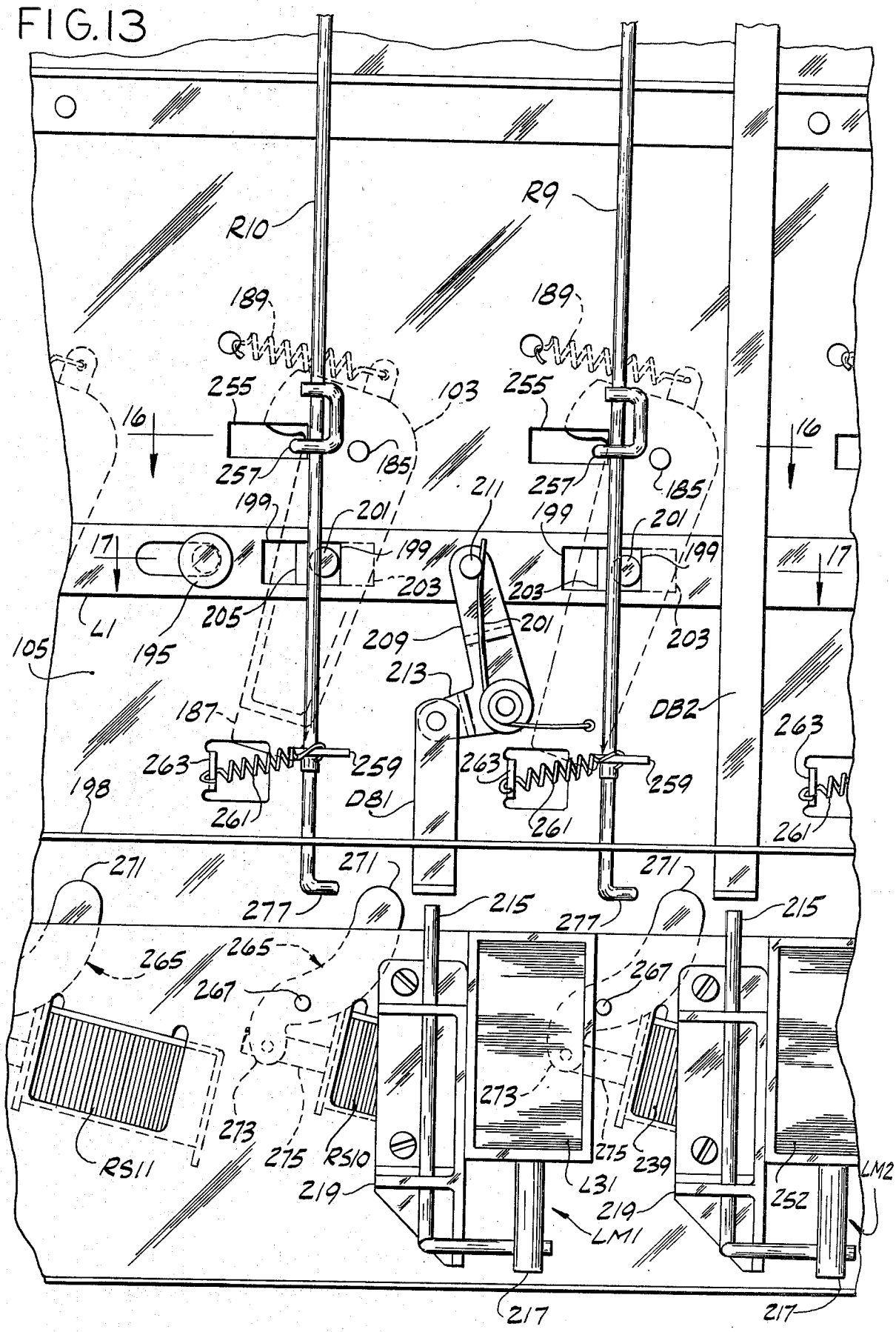
FIGS. 13 and 14 are fragments of FIG. 12 enlarged to show detail.
Figure 14:
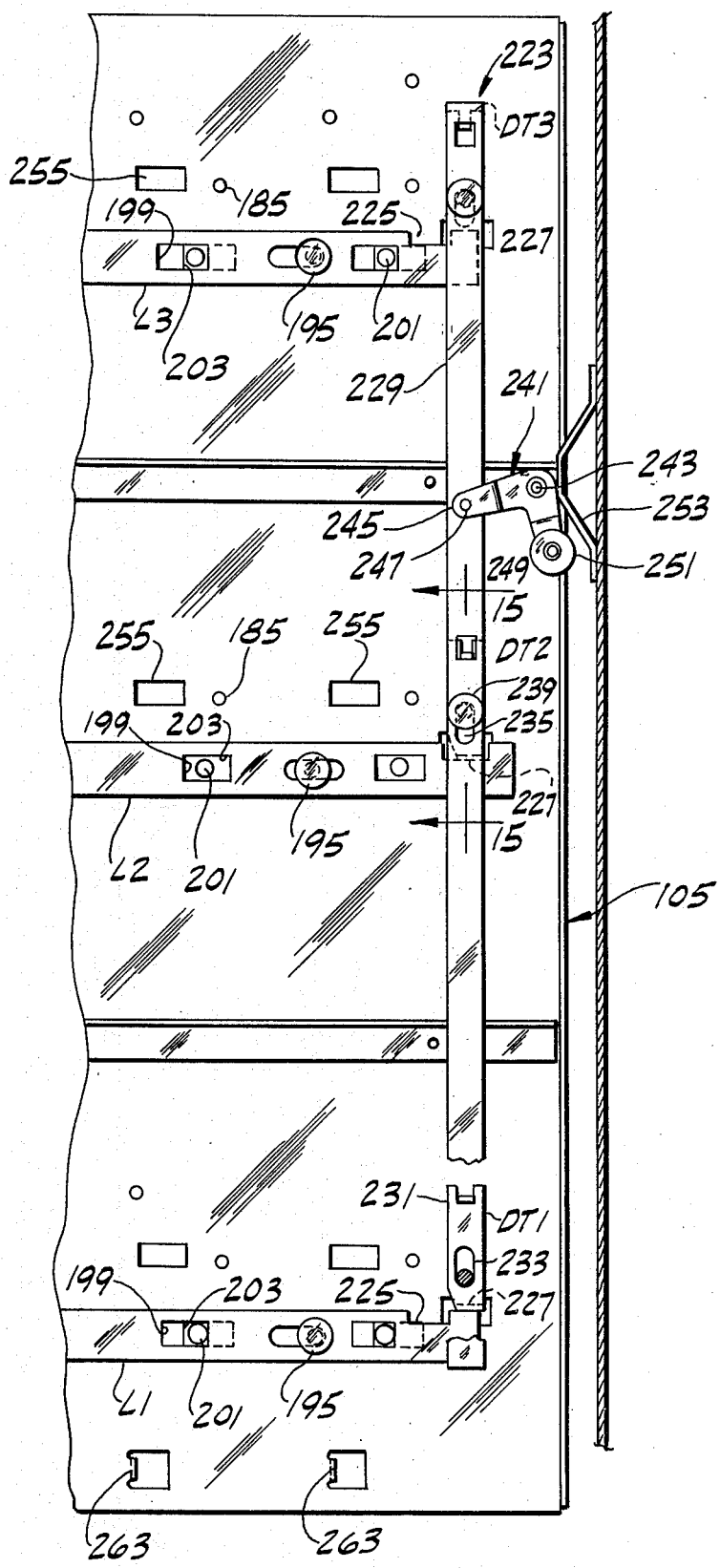

Each of the latch bars L1–L3 is slidable in the direction of its length on the back of plate 105 between the latching position such as illustrated for the bar L1 in FIG. 13 and the lever-releasing position such as illustrated for the bar L2 in FIG. 14. Each of the latch bars L1–L3 has a series of slots 199 therein, one for each of the levers 103 it controls, and each lever 103 has a latch pin 201 extending from its back face through a slot 203 in the plate 105 into the respective slot 199 in the respective latch bar. The arrangement is such that when each latch bar L1–L3 is in its latching position, which is toward the left as viewed in FIGS. 12 and 13, the right ends of the slots 199 in the latch bar, acting against the pins 201, hold the respective levers 103 in their retracted position (as they appear in dotted lines in FIG. 13). When any latch bar moves toward the right as viewed in FIGS. 12 and 13 to its release position, it enables the respective pins 201 to move to the right and thereby enables any one of the respective levers 103 to swing under the bias of its spring 189 to its operative position, if released by the respective latch rod R1–R11.

The latch bars L1, L2, L3 are controlled by solenoid-actuated mechanisms LM1, LM2, LM3, respectively. These mechanisms are generally identical, each comprising a bell crank lever 205 pivoted on a pin 207 on the back of the plate 105, this lever having an upwardly extending arm 209 with a pin and slot connection at 211 to the respective latch bar L1–L3, and a drive bar DB extending down from the other arm 213 of the lever. Each of the levers 205 is located adjacent the respective latch bar (i.e., the lever for L1 is adjacent L1, the lever for L2 is adjacent L2, the lever for L3 is adjacent L3). Hence, the drive bars DB are of different length and, more readily to distinguish each of them from the other two, they are designed DB1, DB2, and DB3, (DB1 being relatively short, DB3 being relatively long, and DB2 being of intermediate length). Each of the three drive bars DB1–DB3 is adapted to be driven up by a drive rod 215 secured to the plunger 217 of a solenoid of the respective mechanism LM1, LM2, LM3, the solenoids being respectively designated LS1, LS2, LS3. When driven up, each drive bar DB1–DB3 swings the respective bell crank 205 clockwise as viewed in FIGS. 12 and 13 to drive the respective latch bar L1, L2, L3 toward the right as viewed in FIGS. 12 and 13 (which is toward the left as viewed in FIG. 11) to its lever-releasing position. The solenoids LS1–LS3 are mounted in fixed position at the bottom of the cabinet. Drive rods 215 are slidable in guides 219 mounted in fixed position alongside the solenoids at the bottom of the cabinet. Each bell crank 205 has a torsion spring 221 associated therewith for biasing the respective latch bar L1–L3 to slide toward the left in FIGS. 12 and 13 to its latching position.

Figure 15:
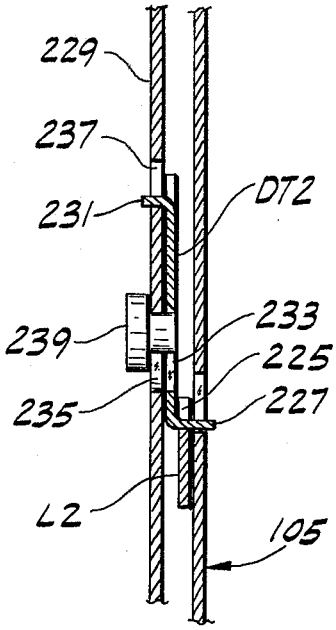
FIG. 15 is an enlarged section on line 15—15 of FIG. 14.

Solenoid LS1 is momentarily energized to slide latch bar L1 to its release position when a customer makes a selection of a pack in tier T1 (after having deposited an amount sufficient for purchase of the selected pack). Solenoid LS2 is momentarily energized to slide latch bar L2 to its release position when a customer makes a selection of a pack in tier T2 (after having deposited an amount sufficient for purchase of the selected pack). Solenoid LS3 is momentarily energized to slide latch bar L3 to its release position when a customer makes a selection of a pack in tier T3 (after having deposited an amount sufficient for purchase of the selected pack). In each instance, since the solenoid is only momentarily energized, provision is made for latching the latch bar (L1, L2 or L3) in its release position. This is accomplished by latch bar latch means indicated generally at 223 in FIGS. 12 and 14. This latch bar latch means comprises three detents, one for each of the three latch bars, the detent for latch bar L1 being designated DT1, the detent for latch bar L2 being designated DT2, the detent for latch bar L3 being designated DT3. These detents are mounted on the back of plate 105 adjacent its right side, as viewed in FIG. 12 (from the back) for up and down sliding movement on the back of the plate. Each latch bar L1, L2, L3 has a notch 225 in its top adjacent its right end as viewed in FIGS. 12 and 14 and each detent DT1–DT3 is adapted to slide down to a latch-bar-latching position (see FIG. 15) wherein a foot 227 at its lower end is entered in the notch 225 to latch the bar in its release position, and is adapted to slide up to a retracted position wherein foot 227 at the lower end of the detent is clear of the notch 225 to release the latch bar for movement to its lever-latching position. The detents DT1–DT3 are controlled by a bar 229 mounted on the back of the plate 105 extending heightwise of the plate adjacent its right side (as viewed from the back) for up and down sliding movement on the back of the plate on the outside of the detents. Each detent comprises a relatively short flat bar (e.g., a sheet metal bar) bent to provide the foot 227 at its lower end, and a finger 231 at its upper end, and formed with a slot 233. The control bar comprises a relatively long flat bar (e.g., a sheet metal bar) having a first series of slots 235 and a second series of slots 237. The control bar and detents are mounted for sliding movement on the back of the plate 105 by means of pins 239 extending through the slots 235 in the control bar and the slots 233 in the detents. Fingers 231 of the detents are received in the slots 237 of the control bar. A bell crank lever 241 is pivoted at 243 on the back of the plate 105 adjacent its right side. Arm 245 of this lever has a pin and slot connection at 247 with the control bar 229, and arm 249 of the lever has a cam follower roller 251 engageable with a fixed cam 253 on the inside of the cabinet at the right of the plate.

Upon each vending cycle, plate 105 is moved up from its lowered retracted position of FIGS. 11–14 through an operating stroke and back down to its lowered retracted position through a return stroke by the motor 183 acting via the crank disk 181 etc. Between vending cycles, the plate 105 dwells in its lowered retracted position. Between vending cycles, latch bars L1–L3 dwell in their latching position holding all thirty-three dispenser actuator levers 103 in their retracted position. The control bar 229 is down (relative to plate 105) in its lowered position (as shown in FIG. 14) determined by engagement of the upper ends of slots 235 in the control bar with the pins 239. The feet 227 at the lower ends of the detents DT1–DT3 engage the tops of the latch bars L1–L3 outward of the notches 225 in the latch bars, the detents thereby being held up in a raised retracted position (as shown for detents D1, DT1 and DT3 in FIG. 14). As the plate 105 moves up, it carries the latch bars L1–L3, the control bar 229, the detents DT1–DT3 and the bell crank 241 up with it. As the crank 241 moves up with the plate 105 and the plate approaches the upper limit of its stroke, the cam follower roller 251 on arm 249 of the crank engages the fixed cam 253 and swings the crank clockwise as viewed in FIG. 14, raising the control bar relative to the plate 105, for detent resetting purposes as will appear.

As noted above, each of the latch rods R1–R11 is mounted for rotation on its own axis in the flanges 197 and 198 and has three latches secured thereto, one for each of the three tier levels, extending through slots 255 in the plate 105 at these levels for controlling the levers 103 for actuating the bell cranks 91. The three latches on each latch rod R1–R11 are designated RL1, RL2 and RL3, RL1 being the lowermost latch of the three and controlling a lever 103 in the lower tier, RL2 being the intermediate latch of the three and controlling a lever 103 in the intermediate tier, and RL3 being the upper latch of the three and controlling a lever 103 in the upper tier. Each latch RL1, RL2, RL3 has a finger 257 which is adapted to extend from the back of the plate 105 through a slot 255 in the plate to the front of the plate in a latching position wherein it engages the respective lever 103 and holds it in its retracted position against the bias of spring 189 (which tends to swing the lever 103 to its operative position).

Figure 16:
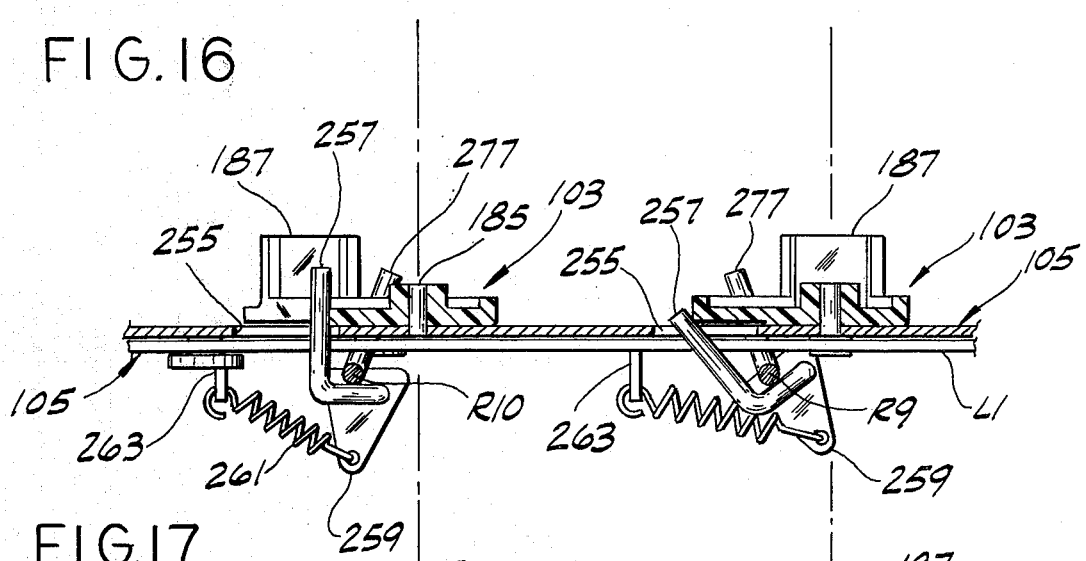
FIG. 16 is a section on line 16—16 of FIG. 13, showing operative and retracted positions of certain latch fingers.

Each of the latch rods R1-R11 has a crank 259 thereon, a spring 261 being interconnected between plate 105 at 263 and the crank 259 biasing the rod to rotate on its axis in the direction to swing the fingers 257 of latches RL1, RL2, RL3 on the rod from their operative position (as shown for the finger 257 at the left in FIG. 16) to their retracted position clear of the respective levers 103 (as shown for the finger 257 at the right in FIG. 16). The latch rods R1–R11 are controlled by solenoid-actuated mechanisms RM1–RM11, respectively. These eleven mechanisms are generally identical, each comprising a lever 265 pivoted at 267 on a panel 269 at the bottom of the cabinet, the lever having arms 271 and 273 extending up and down from its pivot. A solenoid mounted on panel 269 has its plunger 275 connected to the lower end of the lever.These solenoids are respectively designated RS1–RS11 for the eleven rods R1–R11. Each solenoid, when energized, swings the respective lever 265 counterclockwise as viewed in FIG. 13. When the lever is thus swung counterclockwise, its upper arm 271 engages a crank 277 at the lower end of the respective rod R1–R11 and rotates the rod to swing the latch fingers 257 on the rod away from their operative position to their retracted position, for purposes of releasing a lever 103 as will appear.

Figure 2:
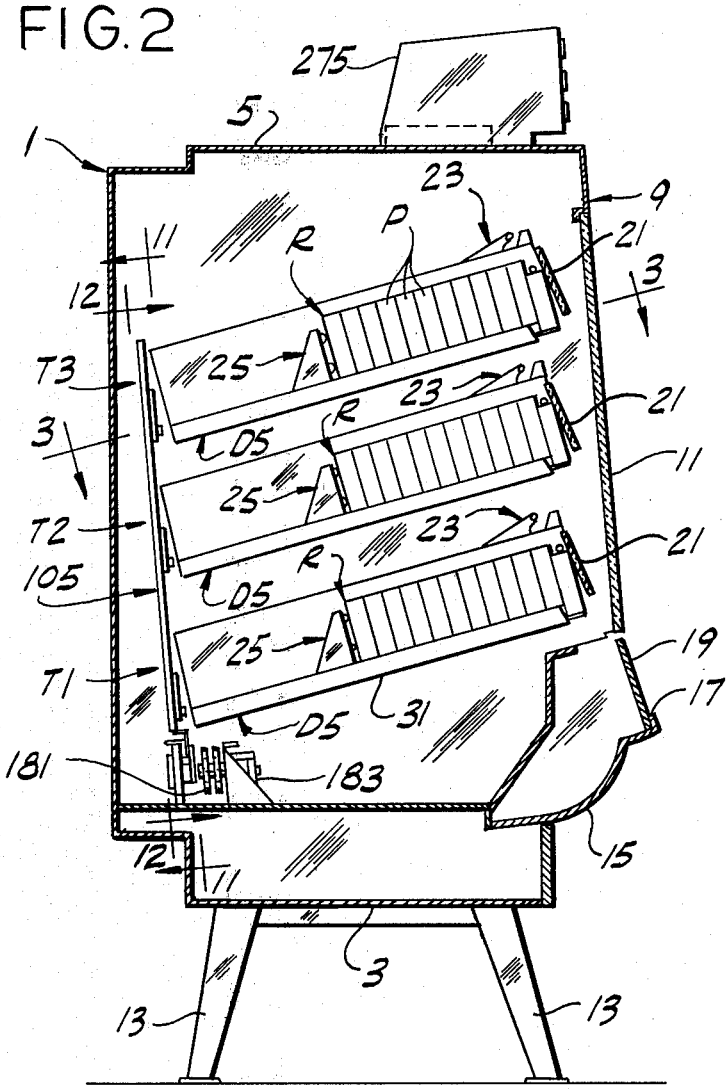
FIG. 2 is a vertical section of the vendor on the front-to-rear plane of the vendor indicated at 2—2 in FIG. 1.
Figure 3:
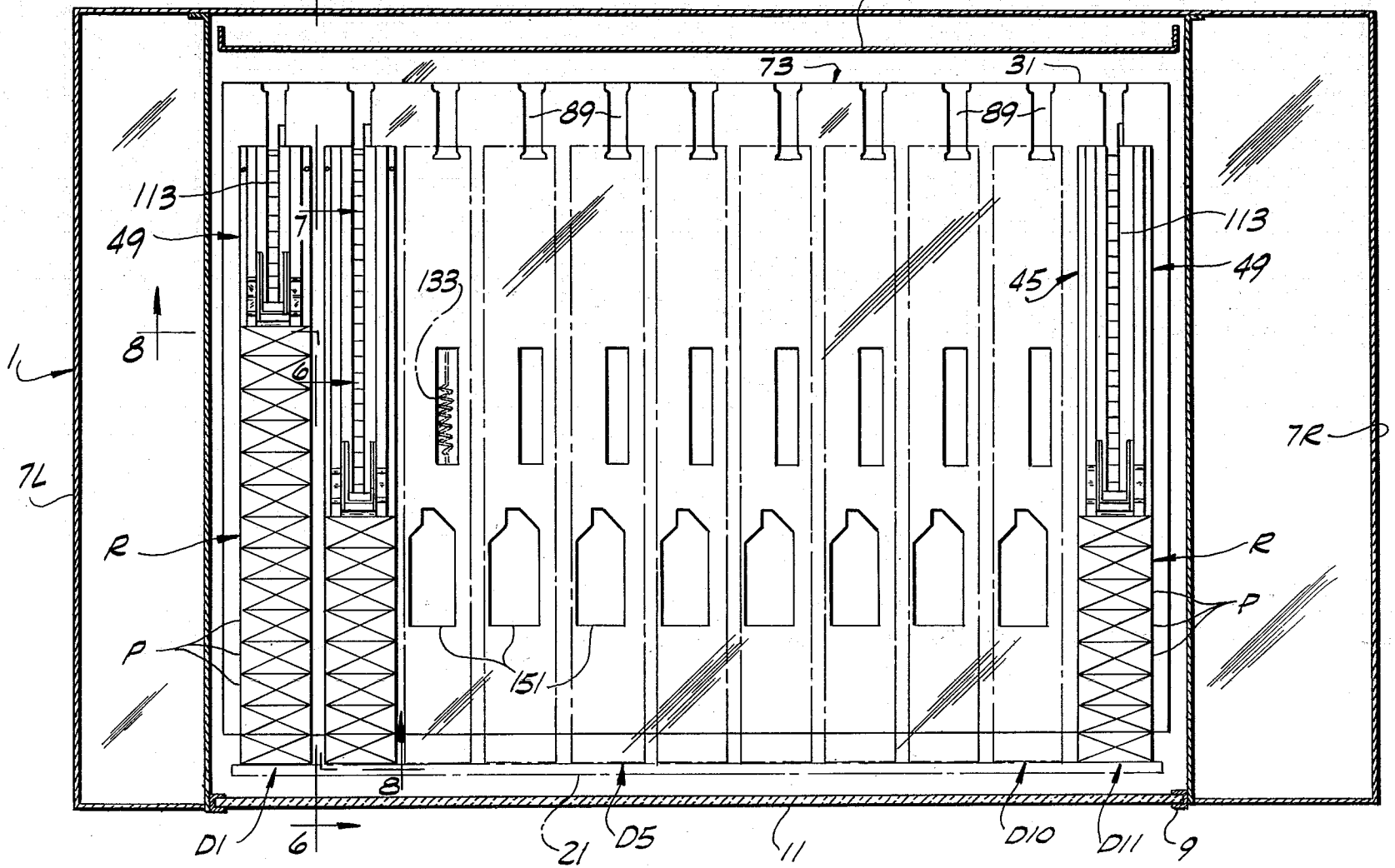
FIG. 3 is an enlarged section on line 3—3 of FIG. 2.
Figure 18:
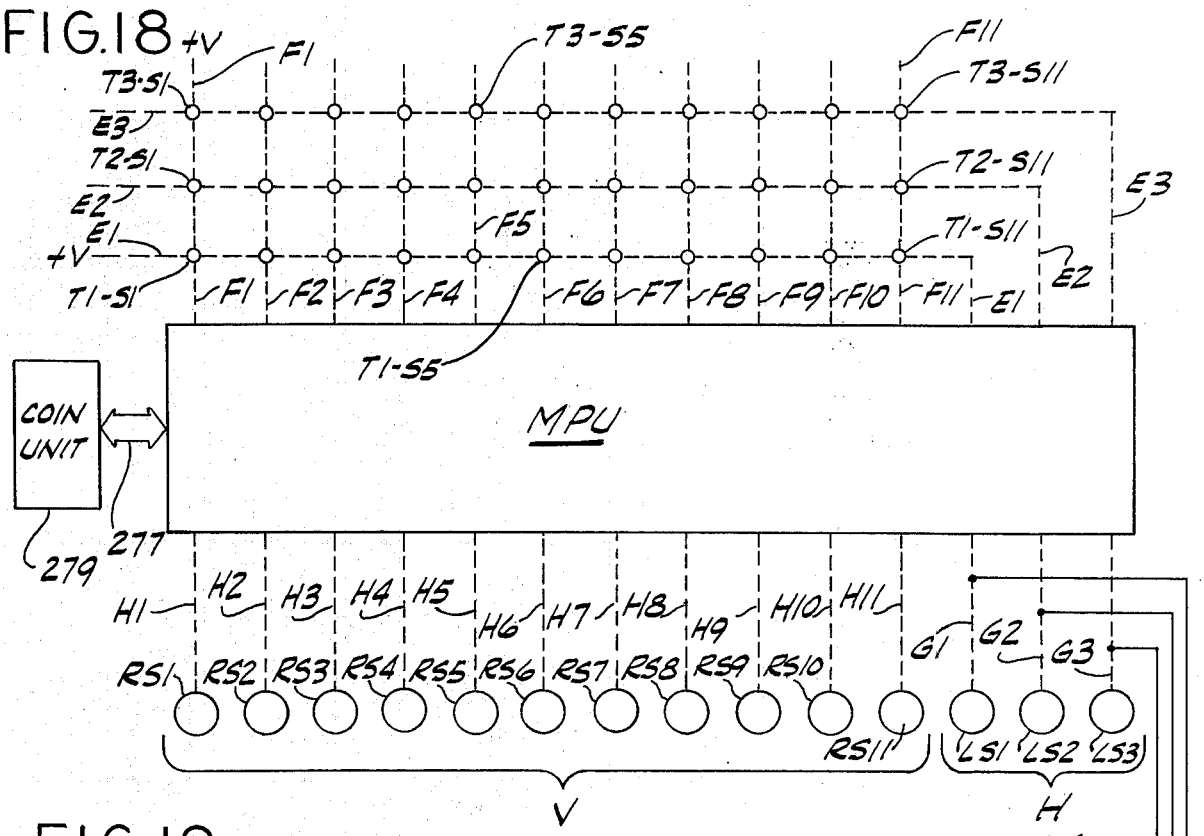
FIG. 18 is a block diagram of electrical circuitry of the apparatus.

As shown in FIGS. 1 and 2, a housing 275 is provided on top of the cabinet 1. At the front of this housing is an array of push button selector switches, one for each of the thirty-three selections provided for in the machine. These selector switches, as shown in FIG. 1 and also in FIG. 18, are arranged in three tiers with eleven switches in each tier corresponding to the three by eleven matrix arrangement of the dispensers T1-D1 to T1-D11, T2-D1 to T2-D11 and T3-D1 to T3-D11 (and the three by eleven matrix arrangement of the thirty-three actuators (bell cranks) 103 for the dispensers. The selector switches of the respective tiers are denoted T1-S1 to T1-S11 for the bottom tier, T2-S1 to T2-S11 for the intermediate tier, and T3-S1 to T3-S11 for the top tier.

The switches in the three tiers of switches T1-T3 are connected in lines E1-E3 to a microprocessor unit MPU, the arrangement being such that whenever any of the T1 switches is actuated, a signal is transmitted via line E1 to the microprocessor unit, whenever any of the T2 switches is actuated, a signal is transmitted via line E2 to the microprocessor unit, and whenever any of the T3 switches is actuated, a signal is transmitted via line E3 to the microprocessor. The rows or columns of switches S1-S11 (corresponding to columns C1-C11) are individually connected in lines F1-F11 to the microprocessor unit, the arrangement being such that whenever any one of the S1 to S11 switches of any tier is actuated, a signal is transmitted via the respective line F1-F11 to the microprocessor unit. As will be readily understood, suitable provision may be made for interlocking the switches so that when any switch is actuated, the others are locked out.

The microprocessor unit MPU is interconnected as indicated at 277 with a credit unit 279, e.g., a conventional coin handling unit (which may also make change), also interconnected as indicated at G1-G3 with solenoids LS1, LS2 and LS3, respectively, and further interconnected as indicated at H1-H11 with solenoids RS1-RS11, respectively. Motor 183 which drives plate 105 up and down is interconnected as indicated at 281 with G1-G3. A suitable conventional control (not shown) is provided for controlling motor 183 in such manner that, upon being energized, it operates through a single-revolution cycle of the disk 181, and stops.

The overall electrical control depicted in FIG. 18 is such that on actuation by a customer of any of the lower tier selection switches T1-S1 to T1-S11 to purchase a pack of cigarettes from the respective dispenser T1-D1 to T1-D11, signals are transmitted to the microprocessor MPU via line E1 and the line F1-F11 in which the switch which has been actuated is connected. The microprocessor, via its interconnection with the credit unit 279, ascertains if a sufficient amount in coin for the purchase of the particular pack has been deposited and, if it has, energizes line G1 to energize solenoid LS1, also energizes the respective one of lines H1-H11 to energize the respective one of solenoids RS1-RS11, and also (via G1) energizes the motor 183.

On actuation by a customer of any of the intermediate tier selection switches T2-S1 to T2-S11 to purchase a pack of cigarettes from the respective dispenser T2-D1 to T2-D11, signals are transmitted to the microprocessor MPU via line E2 and the line F1-F11 in which the switch which has been actuated is connected. The microprocessor, via its interconnection with the credit unit 279, ascertains if a sufficient amount in coin for the purchase of the particular pack has been deposited and, if it has, energizes line G2 to energize solenoid LS2, also energizes the respective one of lines H1-H11 to energize the respective one of solenoids RS1-RS11, and also (via G2) energizes the motor 183.

On actuation by a customer of any of the lower tier selection switches T3-S1 to T3-S11 to purchase a pack of cigarettes from the respective dispenser T3-D1 to T3-D11, signals are transmitted to the microprocessor MPU via line E3 and the line F1-F11 in which the switch which has been actuated is connected. The microprocessor, via its interconnection with the credit unit 279, ascertains if a sufficient amount in coin for the purchase of the particular pack has been deposited and, if it has, energizes line G3 to energize solenoid LS3, also energizes the respective one of lines H1-H11 to energize the respective one of solenoids RS1-RS11, and also (via G3) energizes the motor 183.

Energization of the solenoids in each of the above situations is momentary.

It is preferred that suitable time delay means be incorporated in the circuit for the RS1-RS11 solenoids to be energized, slightly after the LS1-LS3 solenoids are energized and for the motor 183 to be energized slightly after the RS1-RS11 solenoids are energized.

Operation is as follows:

It will be assumed that a customer wishes to buy a pack of cigarettes from dispenser T1-D1 of the lower tier of dispensers. Having deposited a sufficient amount in coin for this purpose, with the corresponding credit being registered by the coin unit 279, he actuates the selection switch T1-S1 (for dispenser T1-D1), with resultant momentary energization as above described of solenoid LS1 of the actuating mechanism LM1 for the latch bar L1, momentary energization of solenoid RS1 of the mechanism RM1 which controls the latch rod R1, and energization of motor 183.

Figure 17:
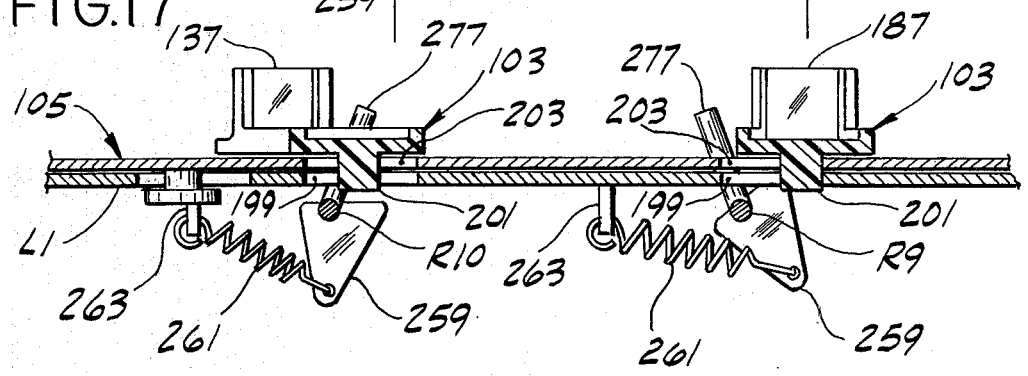
FIG. 17 is a section on line 17—17 of FIG. 13.

Upon energization of solenoid LS1, latch bar L1 slides over from its lever-latching position (in which it is illustrated in FIG. 13) to its lever-releasing position in which the left end of each slot 199 in the latch bar L1 (left as viewed in FIGS. 13 and 17) is spaced toward the right from the control pins 201 of the eleven levers 103 of the lower horizontal row of levers 103. As the latch bar L1 completes its movement to its lever-releasing position (this movement being toward the right as viewed in FIGS. 12 and 14), it becomes latched in its said lever-releasing position by the detent DT1 for latch bar L1, this detent dropping down from the raised retracted position in which it appears in FIG. 14 to its lowered bar-latching position wherein the foot 227 at the lower end of the detent is in the notch 225 in the latch bar L1. Upon energization of solenoid RS1, lever 265 associated therewith rotates latch rod R1 to swing the fingers 257 of the three latches RL1, RL2 and RL3 on rod R1 from their lever-latching position to their lever-releasing position. As a result of movement of latch bar L1 and latch rod R1 to the lever-releasing position, the lever 103 for actuating the dispenser T1-D1, and only that lever 103, is released to be swung by its spring 189 to its operative position for actuating the bell crank lever 91 for dispenser T1-D1. All the levers 103 of tiers T2 and T3 are held in their retracted position by the latch bars L2 and L3 (which remained in their lever-latching positions), and all the other levers 103 of the lower tier are held in their retracted position by the fingers 257 of latches RL1 of latch rods R2-R11 (which remained in their lever-latching positions).

Upon energization of motor 183, crank disks 181 are driven through a single-revolution cycle and act via links 179 and levers 167 to move the carriage or drive plate 105 (which carries all the levers 103) up from its lowered retracted position through its operating stroke during the first half of this cycle, and back down to its lowered retracted position through its return stroke during the second half of the cycle, the motor stopping at the end of the cycle. Plate 105, moving up, carries up the lever 103 for actuating bell crank lever 91 for dispenser T1-D1. With this particular lever 103 in its operative position, the foot 187 at its lower end engages the ball end 99 of said bell crank lever 91 to swing it clockwise as shown in FIG. 7, thereby sliding the trap door 77 of dispenser T1-D1 rearward against the bias of spring 77. This opens up the pack discharge opening 75 of dispenser T1-D1. Also, as the T1-D1 trap door slides rearward, it acts via the T1-D1 spring 161, lever 145 and link 155 to pull down the T1-D1 ejector arm 137 to cause the T1-D1 ejector finger 141 to push the forward pack in T1-D1 down and out through the now-open T1-D1 discharge opening 75, the pack dropping into the delivery pan 15 where it is accessible to the customer.

As the carrier or drive plate 105 approaches the upper level of its upstroke, cam follower roller 251 on arm 249 of crank 241 on the plate 105 engages the fixed cam 253, with resultant clockwise swing of crank 241 (as viewed in FIG. 14) to raise the control bar 229 which carries the detents DT1-DT3, thereby lifting detent DT1 out of the notch 225 in latch bar L1 and allowing the bar to return to its latching position (under the bias of spring 201). As the bar returns, it resets the T1-D1 lever 103 in its retracted position.

As the carriage or drive plate 105 moves back down through its downstroke to its lowered retracted position, the T1-D1 bell crank lever 91 is released to return counterclockwise to its retracted position of FIG. 7 under the bias of spring 107, and this spring returns the T1-D1 trap door 77 to its forward position closing the T1-D1 pack discharge opening. As the T1-D1 trap door slides forward, the T1-D1 lug 159 swings the T1-D1 bell crank 145 counterclockwise to return the T1-D1 ejector arm 137 to its raised retracted position. Also, as the T1-D1 trap door slides forward, it acts via the T1-D1 spring 133 to pull the T1-D1 rack 113 forward and thereby drive the T1-D1 pusher plate 109 forward to push forward the row of packs in the T1-D1 dispenser to the point where the forward pack engages the T1-D1 panel 21 and drops down off the T1-D1 rails 49 onto the T1-D1 trap door 77 at the forward end of the latter, readying it for the next T1-D1 dispensing operation.

It will next be assumed that a customer wishes to buy a pack of cigarettes from dispenser T2-D5 of the intermediate tier of dispensers. Having deposited a sufficient amount in coin for this purpose, with the corresponding credit being registered by the coin unit 279, he actuates the selection switch T2-S5 (for dispenser T2-D5), with resultant momentary energization as above described of solenoid LS2 of the actuating mechanism LM2 for the latch bar L2, momentary energization of solenoid RS5 of the mechanism RM5 which controls the latch rod R5, and energization of motor 183.

Upon energization of solenoid LS2, latch bar L2 slides over from its lever-latching position to its lever-releasing position in which the left end of each slot 199 in the latch bar L2 (left as viewed from the front of plate 105) is spaced from the control pins 201 of the eleven levers 103 of the intermediate horizontal row of levers 103. As the latch bar L2 completes its movement to its lever-releasing position, it becomes latched in its said lever-releasing position by the detent DT2 for latch bar L2, this detent dropping down from its raised retracted position to its lowered bar-latching position wherein the foot 227 at the lower end of the detent is in the notch 225 in the latch bar L2. Upon energization of solenoid RS5, lever 265 associated therewith rotates latch rod R5 to swing the fingers 257 of the three latches RL1, RL2 and RL3 on rod R5 from their lever-latching position to their lever-releasing position. As a result of movement of latch bar L2 and latch rod R5 to the lever-releasing position, the lever 103 for actuating the dispenser T2-D5, and only that lever 103, is released to be swung by its spring 189 to its operative position for actuating the bell crank lever 91 for dispenser T2-D5. All the levers 103 of tiers T1 and T3 are held in their retracted position by the latch bars L1 and L3 (which remained in their lever-latching positions), and all the other levers 103 of the intermediate tier are held in their retracted position by the fingers 257 of latches RL2 of latch rods R1-R4 and R6-R11 (which remained in their lever-latching positions).

Again, upon energization of motor 183, crank disks 181 are driven through a single-revolution cycle and act via links 179 and levers 167 to move the carriage or drive plate 105 (which carries all the levers 103) up from its lowered retracted position through its operating stroke during the first half of this cycle, and back down to its lowered retracted position through its return stroke during the second half of the cycle, the motor stopping at the end of the cycle. Plate 105, moving up, carries up the lever 103 for actuating bell crank lever 91 for dispenser T2-D5. With this particular lever 103 in its operative position, the foot 187 at its lower end engages the ball end 99 of said bell crank lever 91 to swing it clockwise (as shown in FIG. 7), thereby sliding the trap door 77 of dispenser T2-D5 rearward against the bias of spring 77. This opens up the pack discharge opening 75 of dispenser T2-D5. Also, as the T2-D5 trap door slides rearward, it acts via the T2-D5 spring 161, lever 145 and link 155 to pull down the T2-D5 ejector arm 137 to cause the T2-D5 ejector finger 141 to push the forward pack in T2-D5 down and out through the now-open T2-D5 discharge opening 75, the pack dropping into the delivery pan 15 where it is accessible to the customer.

As the carriage or drive plate 105 approaches the upper level of its upstroke, cam follower roller 251 on arm 249 of crank 241 on the plate 105 engages the fixed cam 253, with resultant clockwise swing of crank 241 (as viewed in FIG. 14) to raise the control bar 229 which carries the detents DT1-DT3, thereby lifting detent DT2 out of the notch 225 in latch bar L2 and allowing the latter to return to its latching position (under the bias of spring 201). As the bar returns, it resets the T2-D5 lever 103 in its retracted position.

As the carriage or drive plate 105 moves back down through its downstroke to its lowered retracted position, the T2-D5 bell crank lever 91 is released to return counterclockwise to its retracted position (FIG. 7) under the bias of spring 107, and this spring returns the T2-D5 trap door 77 to its forward position closing the T2-D5 pack discharge opening. As the T2-D5 trap door slides forward, the T2-D5 lug 159 swings the T2-D5 bell crank 145 counterclockwise to return the T2-D5 ejector arm 137 to its raised retracted position. Also, as the T2-D5 trap door slides forward, it acts via the T2-D5 spring 133 to pull the T2-D5 rack 113 forward and thereby drive the T2-D5 pusher plate 109 forward to push forward the row of packs in the T2-D5 dispenser to the point where the forward pack engages the T2-D5 panel 21 and drops down off the T2-D5 rails 49 onto the T2-D5 trap door 77 at the forward end of the latter, readying it for the next T2-D5 dispensing operation.

As another example, it will be assumed that a customer wishes to buy a pack of cigarettes from dispenser T3-D11 of the upper tier of dispensers. Having deposited a sufficient amount in coin for this purpose, with the corresponding credit being registered by the coin unit 279, he actuates the selection switch T3-D11 (for dispenser T3-D11), with resultant momentary energization as above described of solenoid LS3 of the actuating mechanism LM3 for the latch bar L3, momentary energization of solenoid RS11 of the mechanism RM11 which controls the latch rod R11, and energization of motor 183.

Upon energization of solenoid LS3, latch bar L3 slides over from its lever-latching position to its lever-releasing position in which the left end of each slot 199 in the latch bar L1 (again left as viewed from the front of plate 105) is spaced from the control pins 201 of the eleven levers 103 of the upper horizontal row of levers 103. As the latch bar L3 completes its movement to its lever-releasing position, it becomes latched in its said lever-releasing position by the detent DT3 for latch bar L3, this detent dropping down from its raised retracted position to its lowered bar-latching position wherein the foot 227 at the lower end of the detent is in the notch 225 in the latch bar L3. Upon energization of solenod RS11, lever 265 associated therewith rotates latch rod R11 to swing the fingers 257 of the three latches RL1, RL2 and RL3 on rod R11 from their lever-latching position to their lever-releasing position. As a result of movement of latch bar L3 and latch rod R11 to the lever-releasing position, the lever 103 for actuating the dispenser T3-D11, and only that lever 103, is released to be swung by its spring 189 to its operative position for actuating the bell crank lever 91 for dispenser T3-D11. All the levers 103 of tiers T1 and T2 are held in their retracted position by the latch bars L1 and L2 (which remained in their lever-latching positions), and all the other levers 103 of the upper tier are held in their retracted position by the fingers 257 of latches RL3 of latch rods R1-R10 (which remained in their lever-latching positions).

Again, upon energization of motor 183, crank disks 181 are driven through a single-revolution cycle and act via links 179 and levers 167 to move the carriage or drive plate 105 (which carries all the levers 103) up from its lowered retracted position through its operating stroke during the first half of this cycle, and back down to its lowered retracted position through its return stroke during the second half of the cycle, the motor stopping at the end of the cycle. Plate 105, moving up, carries up the lever 103 for actuating bell crank lever 91 for dispenser T3-D11. With this particular lever 103 in its operative position, the foot 187 at its lower end engages the ball end 99 of said bell crank lever 91 to swing it clockwise (as shown in FIG. 7), thereby sliding the trap door 77 of dispenser T3-D11 rearward against the bias of spring 77. This opens up the pack discharge opening 75 of dispenser T3-D11. Also, as the T3-D11 trap door slides rearward, it acts via the T3-D11 spring 161, lever 145 and link 155 to pull down the T3-D11 ejector arm 137 to cause the T3-D11 ejector finger 141 to push the forward pack in T3-D11 down and out through the now-open T3-D11 discharge opening 75, the pack dropping into the delivery pan 15 where it is accessible to the customer.

Again, as the carriage or drive plate 105 approaches the upper level of its upstroke, cam follower roller 251 on arm 249 of crank 241 on the plate 105 engages the fixed cam 253, with resultant clockwise swing of crank 241 (as viewed in FIG. 14) to raise the control bar 229 which carries the detents DT1-DT3, thereby lifting detent DT1 out of the notch 225 in latch bar L1 and allowing the bar to return to its latching position (under the bias of spring 201). As the bar returns, it resets the T3-D11 lever 103 in its retracted position.

As the carriage or drive plate 105 moves back down through its downstroke to its lowered retracted position, the T3-D11 bell crank lever 91 is released to return counterclockwise to its retracted position (FIG. 7) under the bias of spring 107, and this spring returns the T3-D11 trap door 77 to its forward position closing the T3-D11 pack discharge opening. As the T3-D11 trap door slides forward, the T1-D11 lug 159 swings the T3-D11 bell crank 145 counterclockwise to return the T3-D11 ejector arm 137 to its raised retracted position. Also, as the T3-D11 trap door slides forward, it acts via the T3-D11 spring 133 to pull the T3-D11 rack 113 forward and thereby drive the T3-D11 pusher plate 109 forward to push forward the row of packs in the T3-D11 dispenser to the point where the forward pack engages the T3-D11 panel 21 and drops down off the T3-D11 rails 49 onto the T3-D11 trap door 77 at the forward end of the latter, readying it for the next T3-D11 dispensing operation.

The mode of operation on actuation of any other selection switch will be readily apparent from the above. It will be observed that actuation of any selection switch for a dispenser in a particular tier (T1-T3) and column (C1-C11) results in actuation of the latch bar L1-L3 for the respective tier and the latch rod R1-R11 for the respective column.

As to each of the dispensers, the spring 133 provides a resilient interconnection between the trap door 77 and the rack 113. This enables each dispenser not only to handle packs of different thickness, with all packs in the dispenser of the same thickness, but also to handle packs of different thickness at one time. Thus, a dispenser may hold packs ranging in thickness from 9/16" to $1\frac{1}{8}$.

The display of the fronts of the forward packs through the window 11 and transparent panels 21 (with the fronts of the forward packs engaging the panels) is interesting and pleasing in appearance. The forward pack in each dispenser is the one the customer sees and the one that he receives, if he selects it. With the drive plate 105 and associated mechanism at the back of interior of the cabinet (where it is generally relatively dark) the mode of dispensing is not readily apparent, despite the fact that the cabinet has the window 11 at the front. The slanting of the tiers or trays 31 makes for improved visibility of the forward packs; it also enables use of one size of tray for all the tiers.

Figure 19:
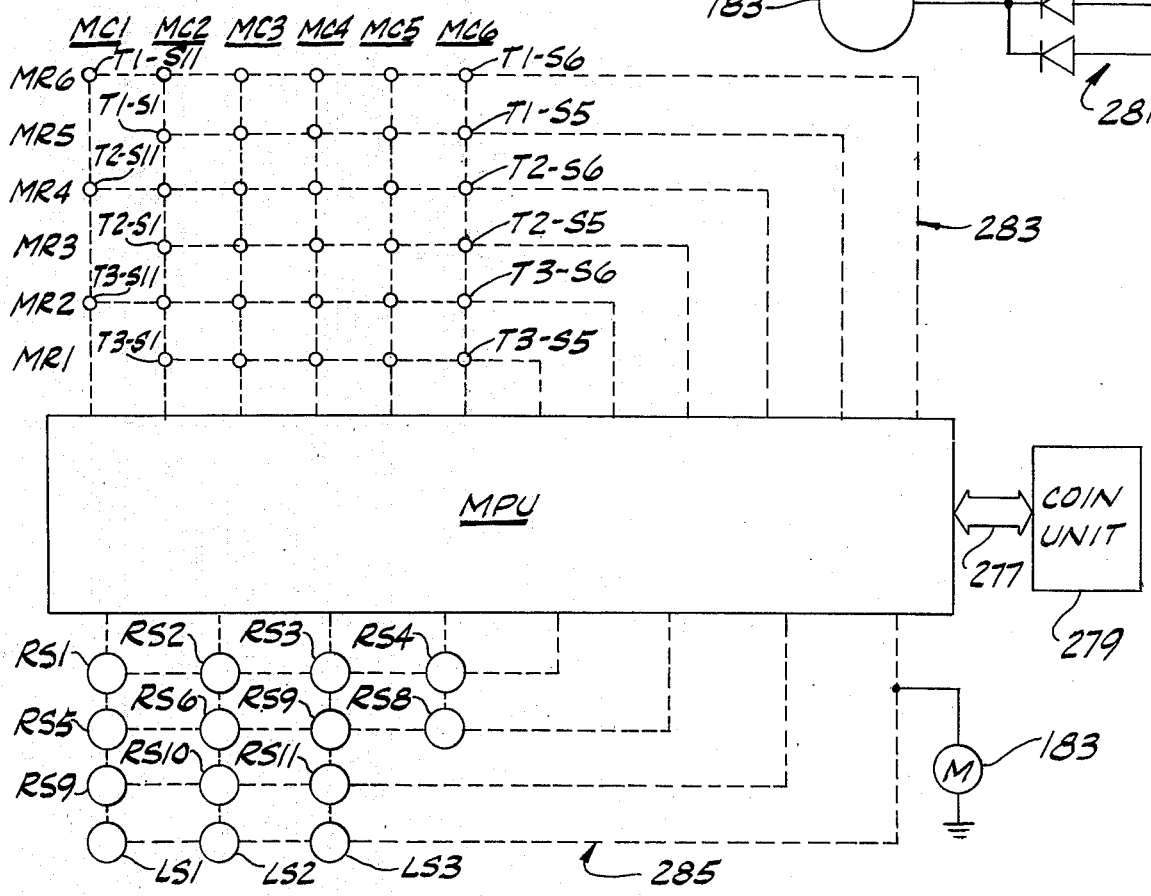
FIG. 19 is a modification of FIG. 18.

FIG. 19 illustrates an alternative electrical control system with a different matrix arrangement for the switches, and a different arrangement for the solenoids. In this alternative system, the switches are arranged in a six-row column matrix, the rows being designated MR1-MR6 (from the bottom up) and the columns being designated MC1-MC6 (from left to right). The six rows and the six columns are connected to the microprocessor unit in a circuit indicated at 283. The solenoids LS1-LS3 and RS1-RS11 and motor 183 are connected to the microprocessor in a circuit indicated at 285. The arrangement is such that on actuation of any one of the selection switches, signals are transmitted to the microprocessor unit MPU via circuit 283, the microprocessor via its interconnection with unit 279 ascertains if a sufficient amount in coin for the purchase of the particular pack has been deposited and, if it has, energizes the respective one of solenoids LS1-LS3 and the respective one of solenoids RS1-RS11 and motor 183 via circuit 285.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Article dispensing apparatus comprising:

a cabinet having a window at the front and a delivery station below the window;

a plurality of article dispensers in the cabinet, each adapted to hold a row of articles extending in rear-to-front direction in the cabinet;

said dispensers being arranged in tiers, one above another, in the cabinet with a plurality of dispensers in each tier located in side-by-side relation in the tier;

each dispenser having stop means fixed in place at its front end engageable by the forward article of the respective row of articles;

the fronts of the forward articles in the rows being visible through the window and the stop means;

means for dispensing the forward article of each row down from behind said stop means; and means for moving the row forward upon the dispensing of the forward article to bring the next article forward into engagement with said stop means;

characterized in that: each dispenser comprises means for bottomwise supporting a row of articles to be dispensed, said stop means being at the forward end of said supporting means, said supporting means having an opening at its forward end rearward of the stop means for downward discharge of the formed article, a trap door movable endwise of the supporting means between a forward position closing said discharge opening and a rearward retracted position for downward discharge of the forward article through said opening, means for moving said trap door from its forward to its rearward position for discharge of the forward article, and back to its forward position, pusher means engageable with the rearward article of the row for pushing the row forward, means operable by the trap door for driving the pusher means forward on a forward stroke of the trap door without driving the pusher means rearward on a rearward stroke of the trap door, and means operable by the trap door on its rearward stroke for pushing the forward article down and out through said opening.

2. Article dispensing apparatus as set forth in claim 1 wherein the means operable by the trap door for driving the pusher means forward includes a resilient interconnection.

3. Article dispensing apparatus as set forth in claim 2 wherein the means operable by the trap door for driving the pusher means forward comprises a rack and a pawl on the pusher means engageable with the rack, the resilient interconnection comprising a spring interconnected between the trap door and the rack.

4. Article dispensing apparatus as set forth in claim 1 wherein the means for moving the trap doors comprises trap door drive members at the rear of the dispensers arranged in rows and columns in a matrix, and having means for selectively driving any one of said drive members to operate a selected dispenser comprising:

a carriage movable through a forward stroke away from a retracted position and back through a return stroke to its said retracted position, a plurality of actuators for said drive members, one for each of the drive members, on the carriage arranged in rows and columns in a matrix corresponding to the drive member matrix, each of said actuators being carried by the carriage for movement relative to the carriage between a retracted position and an operative position wherein it is adapted to operate the respective drive member, control means for the rows of actuators, control means for the columns of actuators, and means operable on selection of a dispenser for actuating the control means for the respective row of actuators and the control means for the respective column of actuators to effect movement of the respective actuator to its operative position for actuating the respective trap door drive member on movement of the carriage.

5. Article dispensing apparatus as set forth in claim 4 wherein the control means for the rows and the control means for the columns of actuators is on the carriage.

6. Article dispensing apparatus as set forth in claim 5 wherein the means for actuating the control means for the rows and the control means for the columns of actuators is off the carriage.

7. Article dispensing apparatus as set forth in claim 6 wherein each of the actuators is biased to move to its operative position, the control means for the rows of actuators comprises a set of latch members, one for each row of actuators, the control means for the columns of actuators comprises a set of latch members, one for each column of actuators, and the means for actuating the control means comprises means fixed relative to the carriage for releasing a respective latch member for the rows and a respective latch member for the columns.

8. Article dispensing apparatus as set forth in claim 7 wherein the carriage is movable up and down, the latch members for the rows comprise bars slidable on the carriage in the direction of the rows away from an actuator-latching position to an actuator-releasing position, and the latch members for the columns comprise rods each extending columnwise on the carriage with respect to the respective column, each rod carrying latches for the actuators of the respective column and being rotatable on its axis away from an actuator-latching position to an actuator-releasing position.

9. Article dispensing apparatus as set forth in claim 8 wherein the means operable on selection of a dispenser comprises a set of solenoids, one for each latch bar, and a set of solenoids, one for each latch rod, for actuating a bar and a rod when the carriage is in its down retracted position, the carraige then moving up for actuation of the selected dispenser.

10. Article dispensing apparatus as set forth in claim 9 having means for latching each latch bar in its actuator-releasing position as the carriage moves up and releasing the latch bar for return to its actuator-latching position before the carriage moves back down to its retracted position.

11. Article dispensing apparatus comprising:

a cabinet having a window at the front and a delivery station below the window;

a plurality of article dispensers in the cabinet, each adapted to hold a row of articles extending in rear-to-front direction in the cabinet;

said dispensers being arranged in tiers, one above another, in the cabinet with a plurality of dispensers in each tier located in side-by-side relation in the tier;

each dispenser having stop means fixed in place at its front end engageable by the forward article of the respective row of articles;

the fronts of the forward articles in the rows being visible through the window and the stop means;

means for dispensing the forward article of each row down from behind said stop means; and means for moving the row forward upon the dispensing of the forward article to bring the next article forward into engagement with said stop means;

characterized in that:

the dispensers are arranged in rows and columns in a matrix, and the apparatus has means for selectively actuating any one of the dispensers comprising:

a carriage movable through a forward stroke away from a retracted position and back through a return stroke to its said retracted position, a plurality of actuators for the dispensers, one for each of the dispensers, on the carriage arranged in rows and columns in a matrix corresponding to the dispenser matrix, each of said actuators being carried by the carriage for movement relative to the carriage between a retracted position and an operative position wherein it is adapted to operate the respective dispenser, control means for the rows of actuators, control means for the columns of actuators, and means operable on selection of a dispenser for actuating the control means for the respective row of actuators and the control means for the respective column of actuators to effect movement of the respective actuator to its operative position for actuating the respective dispenser on movement of the carriage.

12. Article dispensing apparatus as set forth in claim 11 wherein the control means for the rows and the control means for the columns of actuators is on the carriage.

13. Article dispensing apparatus as set forth in claim 12 wherein the means for actuating the control means for the rows and the control means for the columns of actuators is off the carriage.

14. Article dispensing apparatus as set forth in claim 13 wherein each of the actuators is biased to move to its operative position, the control means for the rows of actuators comprises a set of latch members, one for each row of actuators, the control means for the columns of actuators comprises a set of latch members, one for each column of actuators, and the means for actuating the control means comprises means fixed relative to the carraige for releasing a respective latch member for the rows and a respective latch member for the columns.

15. Article dispensing apparatus as set forth in claim 14 wherein the carraige is movable up and down, the latch members for the rows comprise bars slidable on the carriage in the direction of the rows away from an actuator-latching position to an actuator-releasing position, and the latch members for the columns comprise rods each extending columnwise on the carriage with respect to the respective column, each rod carrying latches for the actuators of the respective column and being rotatable on its axis away from an actuator-latching position to an actuator-releasing position.

16. Article dispensing apparatus as set forth in claim 15 wherein the means operable on selection of a dispenser comprises a set of solenoids, one for each latch bar, and a set of solenoids, one for each latch rod, for actuating a bar and a rod when the carriage is in its down retracted position, the carriage then moving up for actuation of the selected dispenser.

17. Article dispensing apparatus as set forth in claim 16 having means for latching each latch bar in its actuator-releasing position as the carriage moves up and releasing the latch bar for return to its actuator-latching position before the carriage moves back down to its retracted position.

18. Article dispensing apparatus comprising means for bottomwise supporting a row of articles to be dispensed, stop means at one end of said supporting means constituting its forward end engageable by the forward article of the row, said supporting means having an opening at its forward end rearward of the stop means for downward discharge of the forward article, a trap door movable endwise of the supporting means between a forward position closing said discharge opening and a rearward retracted position for downward discharge of the forward article through said opening, means for moving said trap door from its forward to its rearward position for discharge of the forward article, and back to its forward position, pusher means engageable with the rearward article of the row for pushing the row forward, means operable by the trap door for driving the pusher means forward on a forward stroke of the trap door without driving the pusher means rearward on a rearward stroke of the trap door, and means operable by the trap door on its rearward stroke for pushing the forward article down and out through said opening.

19. Article dispensing apparatus as set forth in claim 18 wherein the means operable by the trap door for driving the pusher means forward includes a resilient interconnection.

20. Article dispensing apparatus as set forth in claim 19 wherein the means operable by the trap door for driving the pusher means forward comprises a rack and a pawl on the pusher means engageable with the rack, the resilient interconnection comprising a spring interconnected between the trap door and the rack.

21. Apparatus for selectively actuating any one of a plurality of mechanisms, said mechanisms being arranged in rows and columns in a matrix, said apparatus comprising:

a carriage movable through a forward stroke away from a retracted position and back through a return stroke to its said retracted position;

a plurality of actuators for the mechanisms, one for each of the mechanisms, on the carriage arranged in rows and columns in a matrix corresponding to the mechanism matrix;

each of said actuators being carried by the carriage for movement relative to the carriage between a retracted position and an operative position wherein it is adapted to operate the respective mechanism;

control means for the rows of actuators;

control means for the columns of actuators;

means operable on selection of a mechanism for actuating the control means for the respective row of actuators and the control means for the respective column of actuators to effect movement of the respective actuator to its operative position for actuating the respective mechanism on movement of the carriage;

wherein the control means for the rows and the control means for the columns of actuators is on the carriage;

wherein the means for actuating the control means for the rows and the control means for the columns of actuators is off the carriage; and wherein each of the actuators is biased to move to its operative position, the control means for the rows of actuators comprises a set of latch members, one for each row of actuators, the control means for the columns of actuators comprises a set of latch members, one for each column of actuators, and the means for actuating the control means comprises means fixed relative to the carriage for releasing a respective latch member for the rows and a respective latch member for the columns.

22. Apparatus as set forth in claim 21 wherein the carriage is movable in the direction of the rows, the latch members for the rows comprise bars slidable on the carriage in the direction of the rows away from an actuator-latching position to an actuator-releasing position, and the latch members for the columns comprise rods each extending columnwise on the carriage with respect to the respective column, each rod carrying latches for the actuators of the respective column and being rotatable on its axis away from an actuator-latching position to an actuator-releasing position.

23. Apparatus as set forth in claim 22 wherein the means operable on selection of a mechanism comprises a set of solenoids, one for each latch bar, and a set of solenoids, one for each latch rod, for actuating a bar and a rod when the carriage is in its retracted position, the carriage then moving through its forward stroke for actuation of the selected mechanism.

24. Apparatus as set forth in claim 23 having means for latching each latch bar in its actuator-releasing position as the carriage moves through its forward stroke and releasing the latch bar for return to its actuator-latching position before the carriage returns to its retracted position.

* * * * *